US005481274A

United States Patent [19]

Aratani et al.

[11] Patent Number: 5,481,274

[45] Date of Patent: Jan. 2, 1996

[54] DISPLAY CONTROL DEVICE

[75] Inventors: Shuntaro Aratani, Machida; Hiroshi Inoue, Yokohama, both of Japan

[73] Assignee: Canon Kabushiki Kaisha, Tokyo, Japan

[21] Appl. No.: 408,105

[22] Filed: Mar. 21, 1995

Related U.S. Application Data

[63] Continuation of Ser. No. 972,289, Nov. 5, 1992, abandoned.

[30] Foreign Application Priority Data

Nov. 8, 1991 [JP] Japan ..... 3-319668

[51] Int. Cl.[6] ..... G09G 3/36

[52] U.S. Cl. ..... 345/98; 345/97; 359/56

[58] Field of Search ..... 345/98, 97, 55, 345/87, 94; 359/56, 104

[56] References Cited

U.S. PATENT DOCUMENTS

| | | | |
|---|---|---|---|
| 4,655,561 | 4/1987 | Kanbe et al. | 359/56 |
| 4,693,563 | 9/1987 | Harada | 359/56 |
| 4,795,239 | 1/1989 | Yamashita et al. | 359/56 |
| 4,922,241 | 5/1990 | Inoue et al. | 340/784 |
| 4,962,376 | 10/1990 | Inoue et al. | 340/784 |
| 5,058,994 | 10/1991 | Mihara et al. | 359/56 |

FOREIGN PATENT DOCUMENTS

| | | |
|---|---|---|
| 0318050 | 5/1989 | European Pat. Off. . |
| 0361471 | 4/1990 | European Pat. Off. . |
| 0368117 | 5/1990 | European Pat. Off. . |
| 0416172 | 3/1991 | European Pat. Off. . |
| 0433540 | 6/1991 | European Pat. Off. . |

*Primary Examiner*—Curtis Kuntz
*Assistant Examiner*—Minsun Oh
*Attorney, Agent, or Firm*—Fitzpatrick, Cella, Harper & Scinto

[57] ABSTRACT

In order to realize real-time operativity as the man-machine interface for the display on a liquid crystal display unit, there is provided a display control device for receiving image information having a plurality of graphic events, storing the received image information in an image information storing memory, and partially rewriting the display contents on the display unit by transferring the image information in a varied range by a graphic event to the display unit. The display rewrite is enabled at one time for a plurality of partial rewrite display requests in such a manner as to store the scanning range information corresponding to the received image information, when the received image information is stored in the image information storing memory, acquire and store the scanning position information for a partial rewrite being currently executed, and adjust the scanning range of the partial rewrite by judging the duplicate scanning range of the partial rewrite with a comparison between the scanning range information corresponding to the image information and the current scanning position information.

7 Claims, 19 Drawing Sheets

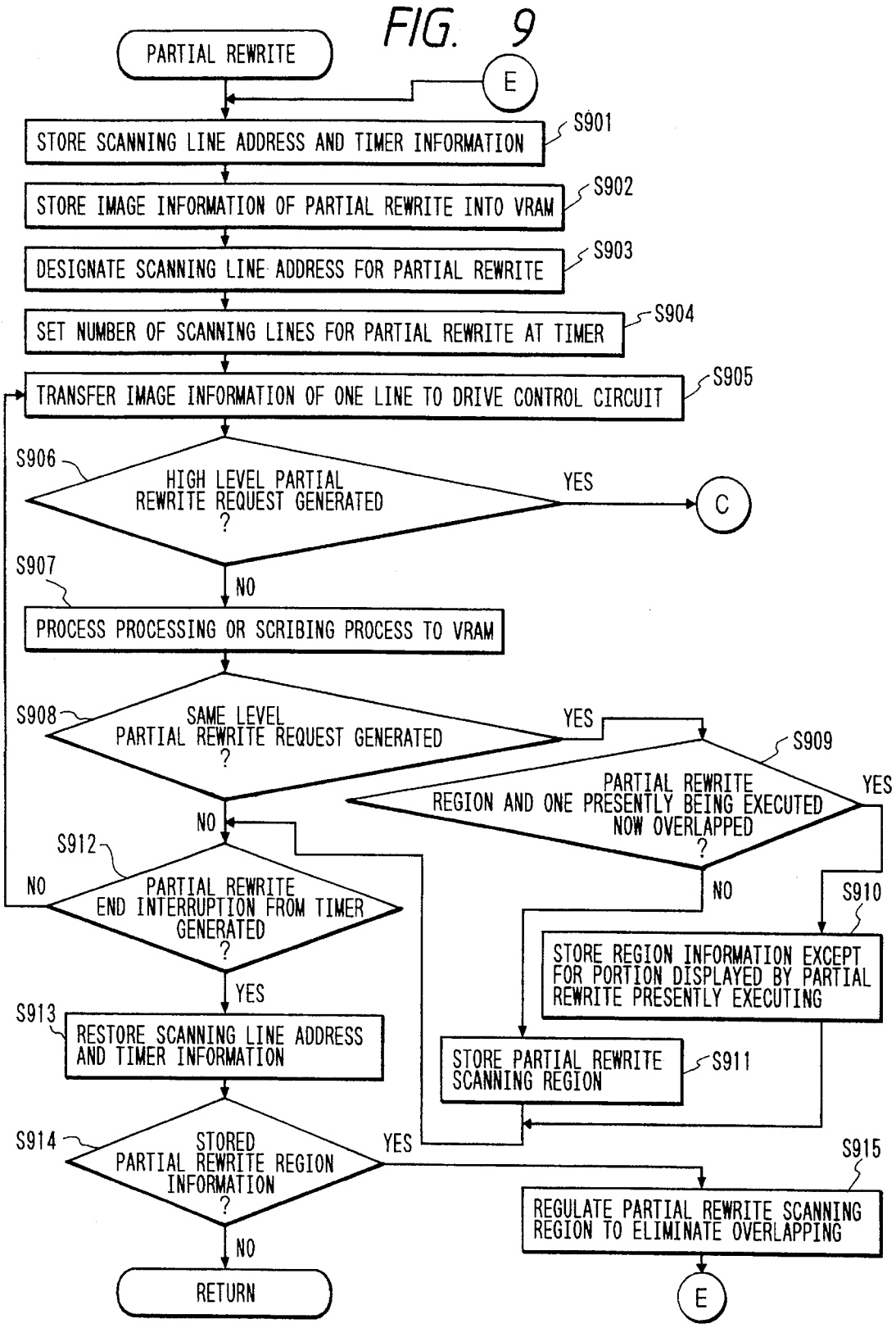
FIG. 9
PARTIAL REWRITE
E
STORE SCANNING LINE ADDRESS AND TIMER INFORMATION
S901
STORE IMAGE INFORMATION OF PARTIAL REWRITE INTO VRAM
S902
DESIGNATE SCANNING LINE ADDRESS FOR PARTIAL REWRITE
S903
SET NUMBER OF SCANNING LINES FOR PARTIAL REWRITE AT TIMER
S904
TRANSFER IMAGE INFORMATION OF ONE LINE TO DRIVE CONTROL CIRCUIT
S905
S906
HIGH LEVEL PARTIAL REWRITE REQUEST GENERATED ?
YES
C
NO
S907
PROCESS PROCESSING OR SCRIBING PROCESS TO VRAM
S908
SAME LEVEL PARTIAL REWRITE REQUEST GENERATED ?
YES
S909
PARTIAL REWRITE REGION AND ONE PRESENTLY BEING EXECUTED NOW OVERLAPPED ?
YES
NO
S912
NO
PARTIAL REWRITE END INTERRUPTION FROM TIMER GENERATED ?
NO
S910
STORE REGION INFORMATION EXCEPT FOR PORTION DISPLAYED BY PARTIAL REWRITE PRESENTLY EXECUTING
YES
S913
RESTORE SCANNING LINE ADDRESS AND TIMER INFORMATION
STORE PARTIAL REWRITE SCANNING REGION
S911
S914
STORED PARTIAL REWRITE REGION INFORMATION ?
YES
S915
REGULATE PARTIAL REWRITE SCANNING REGION TO ELIMINATE OVERLAPPING
NO
RETURN
E

PRIOR ART

PRIOR ART
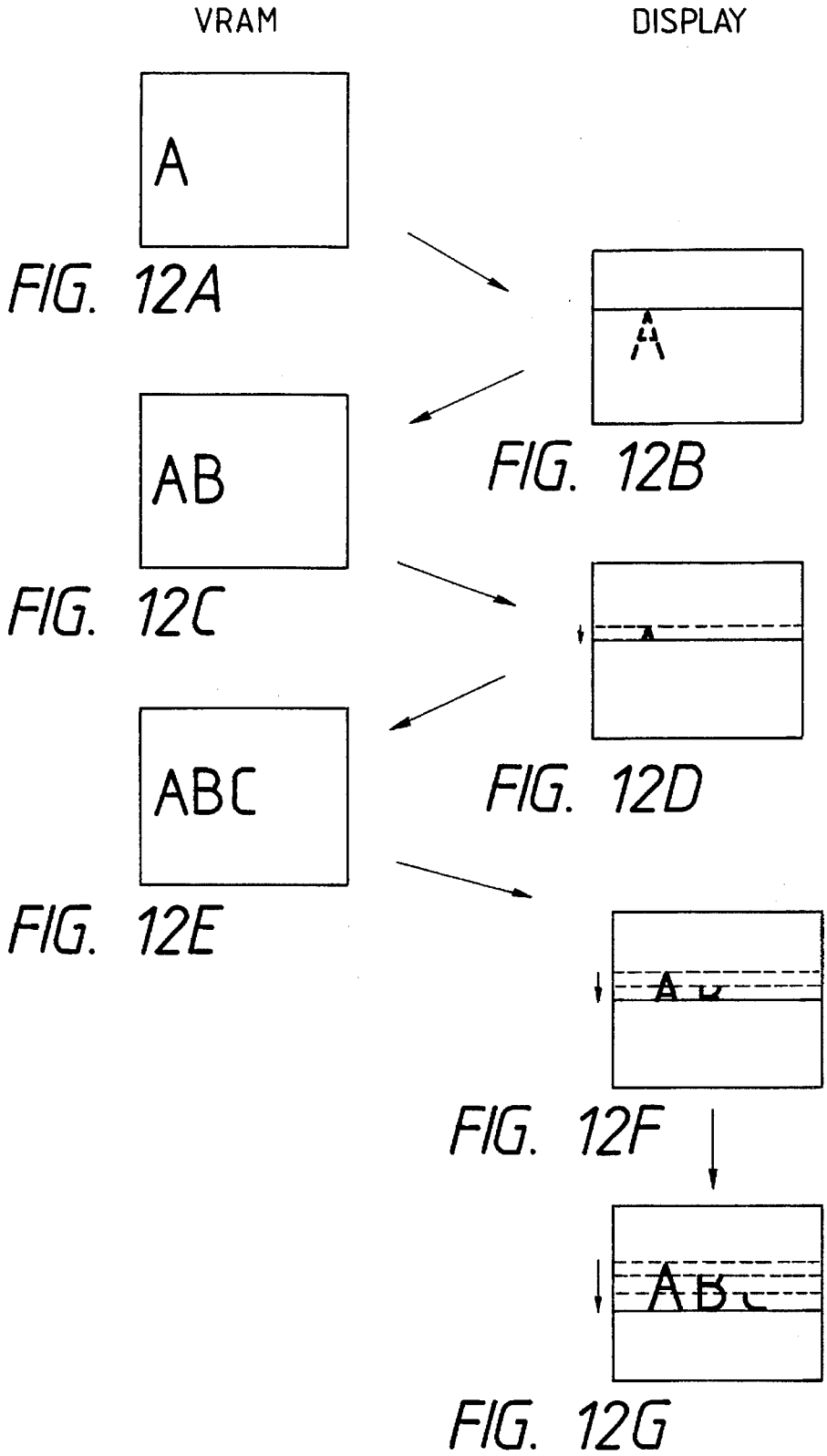

VRAM
DISPLAY
A

A

AB d
e
AB

ABC f
ABC

ABC g
ABC

FIG. 14

| | | (4M-3) FIELD $F_{4M-3}$, (M=1, 2, 3, ··· ) | (4M-2) FIELD $F_{4M-2}$, (M=1, 2, 3, ··· ) | (4M-1) FIELD $F_{4M-1}$, (M=1, 2, 3, ··· ) | 4M FIELD $F_{4M}$, (M=1, 2, 3, ··· ) |
|---|---|---|---|---|---|
| SCANNING SIGNAL | SCANNING SELECTION SIGNAL TO BE APPLIED TO 4n-3TH SCANNING ELECTRODE $S_{4n-3}$, (n=1, 2, 3, ··· ) | $2V_0$ 0 $-2V_0$ | NO SCAN (SCANNING NON-SELECTION SIGNAL) | $2V_0$ 0 $-2V_0$ | NO SCAN (SCANNING NON-SELECTION SIGNAL) |
| | SCANNING SELECTION SIGNAL TO BE APPLIED TO 4n-2TH SCANNING ELECTRODE $S_{4n-2}$, (n=1, 2, 3, ··· ) | NO SCAN (SCANNING NON-SELECTION SIGNAL) | $2V_0$ 0 $-2V_0$ | NO SCAN (SCANNING NON-SELECTION SIGNAL) | $2V_0$ 0 $-2V_0$ |
| | SCANNING SELECTION SIGNAL TO BE APPLIED TO 4n-1TH SCANNING ELECTRODE $S_{4n-1}$, (n=1, 2, 3, ··· ) | $2V_0$ 0 $-2V_0$ | NO SCAN (SCANNING NON-SELECTION SIGNAL) | $2V_0$ 0 $-2V_0$ | NO SCAN (SCANNING NON-SELECTION SIGNAL) |
| | SCANNING SELECTION SIGNAL TO BE APPLIED TO 4nTH SCANNING ELECTRODE $S_{4n}$, (n=1, 2, 3, ··· ) | NO SCAN (SCANNING NON-SELECTION SIGNAL) | $2V_0$ 0 $-2V_0$ | NO SCAN (SCANNING NON-SELECTION SIGNAL) | $2V_0$ 0 $-2V_0$ |
| | SCANNING NON-SELECTION SIGNAL | 0 | 0 | 0 | 0 |

DISPLAY CONTROL DEVICE

This application is a continuation of application Ser. No. 07/972,289, filed Nov. 5, 1992, now abandoned.

BACKGROUND OF THE INVENTION

1. Field of the Invention

The present invention relates to a display control device for the so-called partial rewrite of the display contents on a liquid crystal display unit, and more particularly to a display control device suitable in combination with a liquid crystal display unit using a ferroelectric liquid crystal having memory property.

2. Related Background Art

Conventionally, refresh scan-type CRTs have been mainly used as the computer terminal display, and vector scan-type CRTs having memory property have been partially used as the CAD oriented large-scale high definition display. A vector scan-type CRT is unsuited for the man-machine interface display for use in real-time, such as the cursor shift display, the icon-based display useful for the information display from a pointing device such as a mouse, and the edit display (insert, delete, move, copy) of characters and texts, because the picture, once displayed, is not updated until it is erased.

On the other hand, a refresh scan-type CRT requires a refresh cycle of 60 Hz or greater as the frame frequency from the viewpoint of preventing the flicker (picture flicker), and adopts a non-interlace method to improve the visibility in the shift display (shift display of icon) of the information within a screen (note that TV adopts a ½ interlace method with a field frequency of 60 Hz and a frame frequency of 30 Hz from the consideration of the display of moving picture and the simplicity of drive control system). Therefore, with a higher display resolution, the display unit is larger, resulting in a higher power, a larger drive control and a higher cost.

In the background of the recent advent of flat panel displays, there is the inconvenience with such larger and higher power CRTs.

At present, several types of flat display panels have been known. For example, a high time-division drive system (STN) with the twist nematic liquid crystal, its variation for the white and black display (NTN), or a plasma display system, takes the same image data transfer method as that for the CRT, with its picture update method being a non-interlace method having a frame frequency of 60 Hz or greater. A large-size flat display panel in which the total number of scanning lines in one picture is from 400 to 800 lines, and 1000 lines or greater, has no memory property on the driving principle, and thus requires a refresh memory having a frame frequency of 60 Hz or greater to prevent the flicker. Accordingly, one horizontal scanning time was as short as 10 to 50 μsec or less, and excellent contrast could not be attained.

A ferroelectric liquid crystal display has a memory property, and is able to make a display on a larger screen and at a higher definition than with the above-mentioned display. However, by virtue of driving at its low frame frequency, to cope with the display unit with the man-machine interface as previously described, a partial rewrite scanning (for scanning only the scanning lines within a rewrite region) which can make effective use of the memory property has been recommended. This partial rewrite scanning system has been disclosed in, for example, U.S. Pat. No. 4,655,561 by Kanbe.

This partial rewrite scanning system is based on a method in which the partial rewrite scanning is performed by designating a partial rewrite scanning start address and end address, and a method of using a circuit (e.g., a timer) for controlling the partial rewrite scanning time.

Among them, the method of using a circuit for controlling the partial rewrite scanning time allows for other image processing instructions or partial rewrite scanning during the partial rewrite scanning, whereby the display with the mouse or cursor shift can be made during the scroll display on a multi-window. However, with the conventional method, in making other partial rewrites during a partial rewrite scanning, the partial rewrite scanning region was designated for each partial rewrite request so that if the partial rewrite scanning region overlapped, duplicate scanning was performed in the same scanning region. Thereby there was a problem that the partial rewrite process might take a more time than necessary.

For example, in operation with the window scroll display and the pointing device display, it is assumed that a partial rewrite scanning request for the window scroll display is first generated, and then a display request from a pointing device is generated after the partial rewrite scanning with scroll on the display panel. The rewrite display for the pointing device will be immediately conducted, and then the scroll display will be made again, but the method of designating the partial rewrite scanning region with the partial rewrite request itself for the scroll display had a problem that if the pointing device existed within the scroll area, a region already displayed by the partial rewrite of the pointing device was scanning again by the scroll partial rewrite, so that duplicate scanning was made, taking more time than necessary to complete a partial rewrite process.

Also, with the conventional method, when a partial rewrite instruction having the same level of priority was generated during the partial rewrite process, either a method of storing no image information or a method of storing only the image information and not performing the partial rewrite until the termination of the partial rewrite being currently executed was adopted. This is due to the fact that as the partial rewrite scanning region is designated for each partial rewrite request, when one partial rewrite is being currently executed, other partial rewrites must be either delayed until the end or ignored. Accordingly, there was a problem that in a former method, the partial rewrite process required a greater time, and in a latter method, the display was not enabled.

SUMMARY OF THE INVENTION

In the light of the above-mentioned problems, an object of the present invention is to provide a display control device for making a display on a liquid crystal display unit which can realize the real-time operativity as the man-machine interface.

It is another object of the present invention to provide a display control device in which in the partial rewrite on a display unit having memory property such as a ferroelectric liquid crystal display, the scanning region information for each partial rewrite request is stored, and the current scanning position information is acquired, compared and adjusted, whereby the duplicate partial rewrite is prevented, so that a higher speed of partial rewrite process is made possible, and further a plurality of partial rewrite requests can be put together into one partial rewrite to make the display. Further, it is another object of the present invention to provide a display control device which allows for a higher speed partial rewrite display even if partial rewrites at the same level of priority consecutively may occur.

In addition, it is another object of the present invention to provide a display system having a display control device which can accomplish the above objects and a display control method with which the above objects can be accomplished.

It is a further object of the present invention to provide a display control device comprising means for receiving the image information having a plurality of graphic events, means for storing the received image information in an image information storing memory, and partial rewrite means for partially rewriting the display contents on a display unit by transferring the image information in a varied range by a graphic event to said display unit, wherein there are provided means for storing the scanning range information corresponding to the received image information, when the received image information is stored in said image information storing memory, means for acquiring and storing the scanning range and the scanning position information for a partial rewrite being currently executed, and means for adjusting said partial rewrite scanning range by judging the duplicate scanning range to be overlapped by a plurality of partial rewrites with a comparison between the scanning range information corresponding to the image information, the scanning range for a partial rewrite being currently executed and the current scanning position information, whereby the display rewrite for the image information with the plurality of graphic events is enabled by at least one or more partial rewrites.

Also, it is another object of the present invention to provide a display control method for making a display corresponding to the image information having a plurality of graphic events by partially rewriting the display contents on a display unit, including the steps of judging the duplicate scanning range of partial rewrite with a comparison between the scanning range for a partial rewrite being currently executed, the scanning position information, and the partial rewrite information according to the priority level for the image information arising during the execution of the partial rewrite, executing the partial rewrite in a duplicate scanning range portion following one being currently executed in said duplicate scanning range, and then reexecuting the partial rewrite for the remaining portion of the partial rewrite already executed in said duplicate scanning range, whereby the display rewrite for the image information with a plurality of graphic events is enabled by at least one or more partial rewrites.

BRIEF DESCRIPTION OF THE DRAWINGS

FIGS. 7 to 9 are flowcharts showing an example of an algorithm for the partial rewrite used in this embodiment.

FIGS. 10 and 12 are explanation views showing a display example with a conventional partial rewrite method.

FIGS. 14 and 15 are drive waveform charts for explaining an example of a drive waveform used in this embodiment.

DETAILED DESCRIPTION OF THE PREFERRED EMBODIMENTS

A display unit for use in the present invention is preferably a liquid crystal display from the respect of a lower power, a smaller size and a lighter weight. When the liquid crystal display is used as a display unit, the liquid crystal display preferably has a liquid crystal panel having a memory property. Such a liquid crystal display panel having the memory property may be made by using a ferroelectric liquid crystal, or forming a TFT circuit on a liquid crystal substrate such as a twist nematic liquid crystal display panel to provide the memory property.

According to a display control device of the present invention, there is provided means for storing the partial rewrite scanning range information when a partial rewrite request occurs, acquiring the scanning position information of a partial rewrite being currently executed, and adjusting the information with a comparison between them. In this manner, the duplicate scanning of partial rewrite is eliminated, and a plurality of partial rewrite requests can be displayed by a one time partial rewrite, so that the partial rewrite time is shortened, and the real-time image display or the operativity can be realized.

The embodiments of the present invention will be now described with reference to the drawings.

Figure 1:
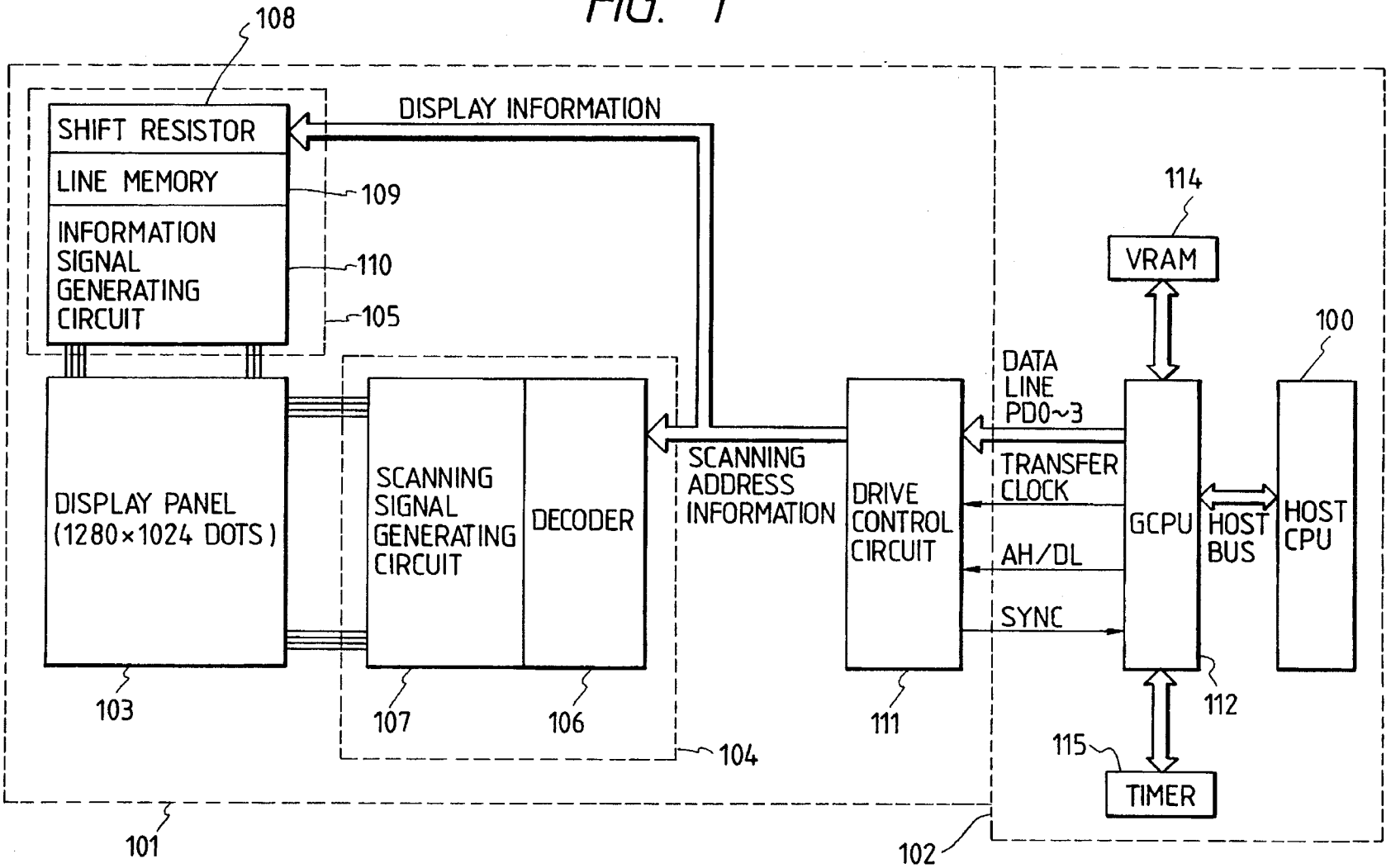
FIG. 1 is a block diagram showing a liquid crystal display unit and a graphic controller according to a preferred embodiment of the present invention.

FIG. 1 is a block constitutional view for a ferroelectric liquid crystal display unit 101 and a graphics controller 102 according to a preferred embodiment of the present invention. The graphics controller 102 is normally provided on the main device side of a personal computer or the like which is a supply source of the display information. A display panel 103 is one in which a ferroelectric liquid crystal is enclosed between two sheets of glass plates having 1024 lines of scanning electrodes and 1280 lines of information electrodes arranged as a matrix, and subjected to an orientation treatment. A scanning line drive circuit 104 and an information line drive circuit 105 constitute a display drive circuit of the liquid crystal display, with the scanning line of the liquid crystal display connected to the scanning line drive circuit 104, and the information line connected to the information line drive circuit 105. A host CPU 100 controls the operation of the main device.

Figure 2:
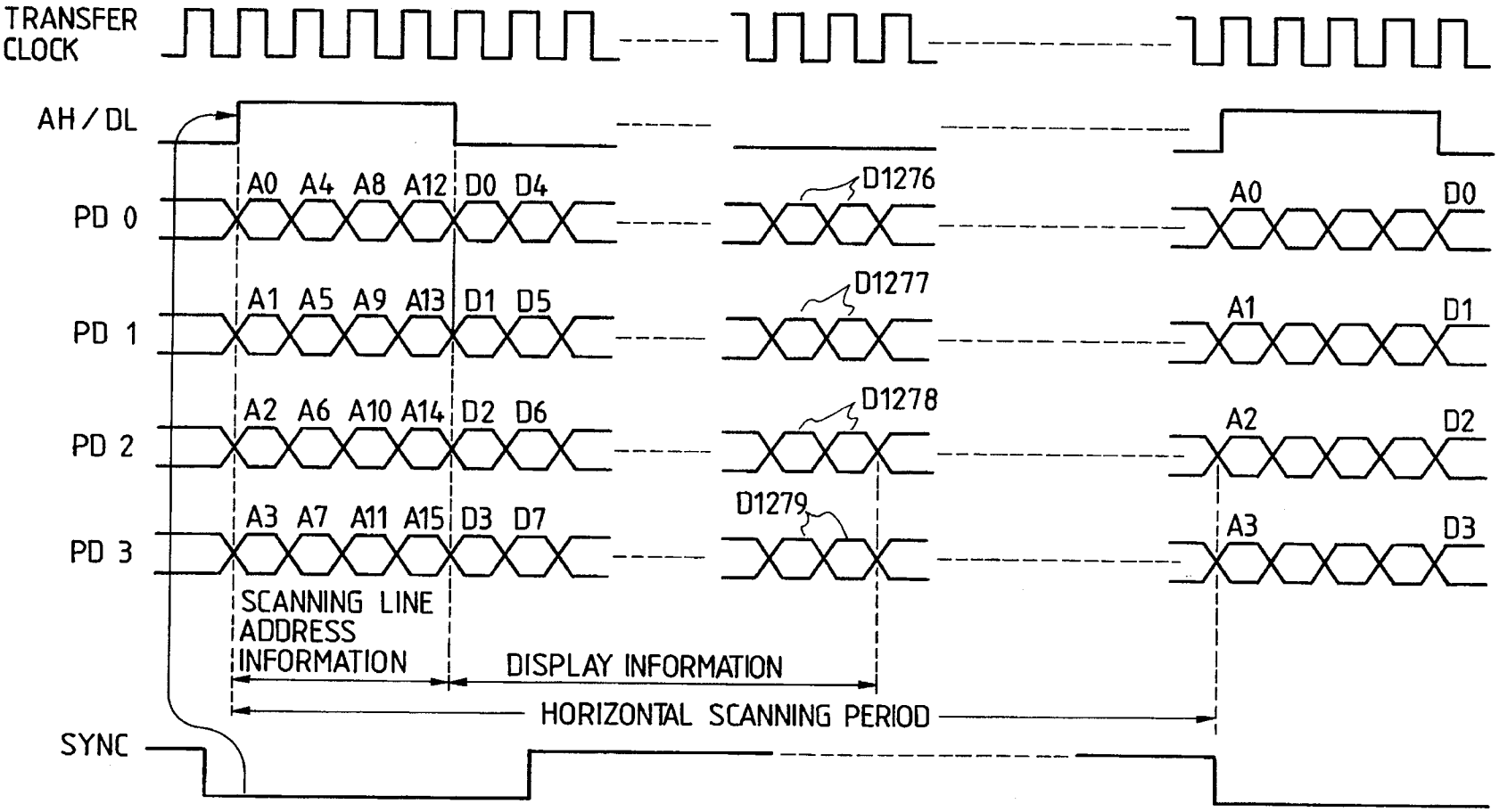
FIG. 2 is a timing chart of the image information communication between the liquid crystal display unit and the graphic controller as shown in FIG. 1.

FIG. 2 is a timing chart of the communication of the image information. Referring to FIG. 2, the operation of the circuit as shown in FIG. 1 will be described below. The graphics controller 102 transfers the scanning line address information for designating the scanning electrode, and the image information (PD0 to PD3) on the scanning line designated by its address information to the display drive circuits 104 and 105 of the liquid crystal display 101. Since in this embodiment the image information having the scanning line address information and the display information is transferred on the same transmission path, the information of two types as above described must be distinguished. A signal useful for this identification is AH/DL, wherein when this AH/DL signal is at "H" level, the scanning line address information is indicated, while when it is at "L" level, the display information is indicated.

The scanning line address information is transferred to a decoder 106 and a scanning signal generating circuit 107 after being extracted from the image information which has been transferred as the image information PD0 to PD3 in a drive control circuit 111 within the liquid crystal display 101. The scanning signal generating circuit 107 drives a scanning electrode designated in accordance with the scanning line address information. On the other hand, the display information, after being extracted from the image information PD0 to PD3 by the drive control circuit 111, is led to a shift register 108 within the information line drive circuit 105 so that it is shifted in a unit of four pixels with the transfer clock. If shifting of one scanning line in a horizontal direction is completed by the shift register 108, the display information consisting of 1280 pixels is transferred to a line memory 109 juxtaposed therewith to be stored for one horizontal scanning period, and then output as a display information signal from an information signal generating circuit 110 to each information electrode.

In this embodiment, since the driving of the display panel 103 in the liquid crystal display 101 and the generation of the scanning line address information and the display information in the graphics controller 102 are performed asynchronously, it is necessary to synchronize the devices 101 and 102 at the transfer of the image information. This synchronizing signal is a SYNC, which is generated by the drive control circuit 111 within the liquid crystal display 101 for each horizontal scanning period. The graphics controller 102 monitors the SYNC signal at all times, wherein if the SYNC signal is at "L" level, the image information is transferred, while if it is at "H" level, the image information is not transferred after the image information for one horizontal scanning line has been transferred. That is, in FIG. 2, if the graphics controller 102 detects that the SYNC signal is at the "L" level, the AH/DL signal is immediately turned at the "H" level, and then the transfer of the image information for one horizontal scanning line is started. The drive control circuit will within the liquid crystal display 101 turns the SYNC signal at the "H" level during the transfer period of the image information. After the writing to the display panel 103 has been terminated in a predetermined one horizontal scanning time, the drive control circuit (FLCD controller) 111 returns the SYNC signal to the "L" level, and is ready to receive the image information at the next scanning line.

Figure 3:
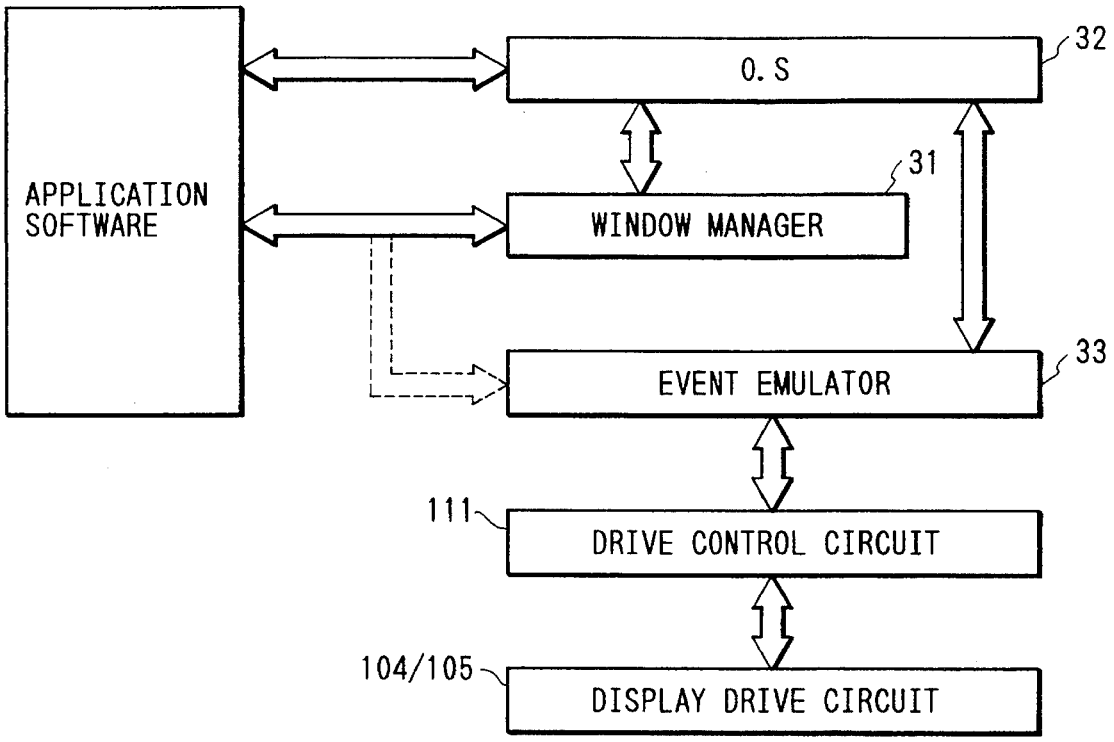
FIG. 3 is a block diagram for explaining an example of a display control program used in this embodiment.

In this example, an image display control program as shown in FIG. 3 has a feature of accepting a picture display request from the external via an update procedure as shown, and performing the transfer control of the image information to the ferroelectric liquid crystal display (FLCD) 101. This image display control program serves to selectively transfer the image information to the display unit 101 synchronously in such a manner as to judge a rewrite region and the drawing process onto a VRAM (image information storing memory) necessary for the rewrite on the basis of the display priority level, when at least one request for rewriting the contents already displayed is generated.

For a communication procedure as shown in FIG. 3, a window manager 31 and an operating system (OS) 32 are used. The operating system (OS) 32 for use may be "MS-DOS" ( trade name ) made by MicroSoft in U.S., "XENIX" (trade name) made by the same company, "UNIX" (trade name) made by AT&T in U.S., "MS-Windows" (trade name) made by MicroSoft in U.S., "OS/2 Presentation Manager" (trade name) made by MicroSoft in U.S., "X-Window" of public domain, or "DEC-Window" made by Digital Equipment in U.S. An event emulator 33 as shown may be "MS-DOS & MS-Windows" or "UNIX & X-Window" in a pair.

This embodiment realizes a liquid crystal display unit based on a partial rewrite scanning algorithm on the graphics controller side as hereinafter described by adopting a data format consisting of the image information having the scanning line address information as shown in FIGS. 1 and 2, and communication synchronizing means with the SYNC signal.

The image information is generated by the graphics controller 102 on the main device side, and transferred to the display panel 103 by signal transfer means as shown in FIGS. 1 and 2. The graphics controller 102 performs the control and communication of the image information between the host CPU 100 and the liquid crystal display unit 101 with the core of a CPU (central Processing Unit) 112 (thereinafter abbreviated as GCPU 112) and VRAM (image information storing memory) 114, with the control method in this embodiment principally implemented on the graphics controller 102.

Figure 4:
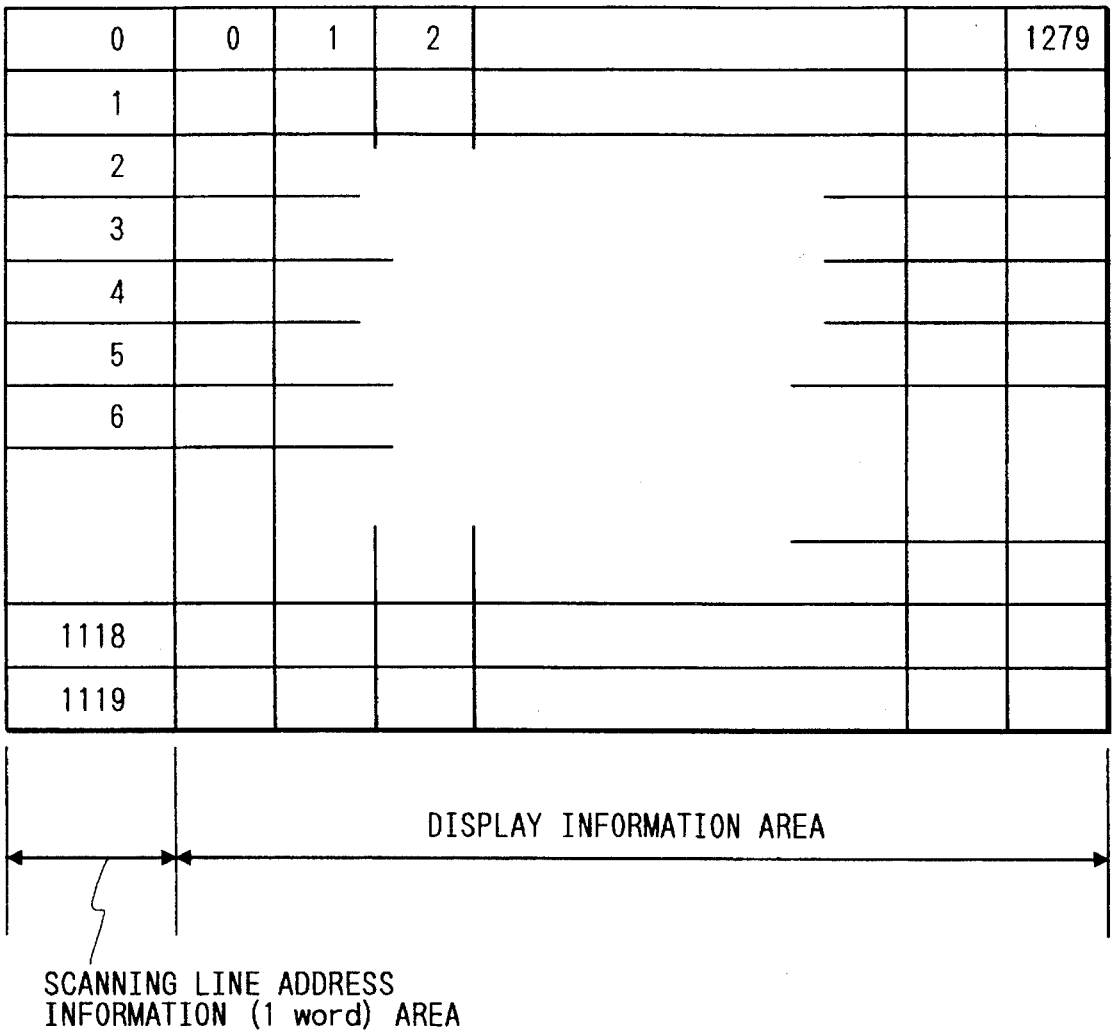
FIG. 4 is an explanation view showing an example of the data mapping for the scanning line address information and the display information on a VRAM 114 used in this embodiment.

Herein, in order to take the data format consisting of the image information including the scanning line address information, the scanning address information may be added using an address adding circuit, but in this embodiment, the image information was mapped onto the VRAM 114 as shown in FIG. 4. That is, the VRAM 144 was divided into two areas, one for the scanning line address information region, and the other for the display information region. The image information is arranged one line transversally so that the information on the VRAM 114 correspond to the pixels on the display panel 103 one by one, with the scanning line address information embedded at a top end (left end) of the image information of one line. GCPU 112 reads the information in a unit of one line from the left end of the VRAM 114, and sends out it to the liquid crystal display 101, whereby the data format consisting of the image information having the scanning line address information can be realized.

Figure 5:
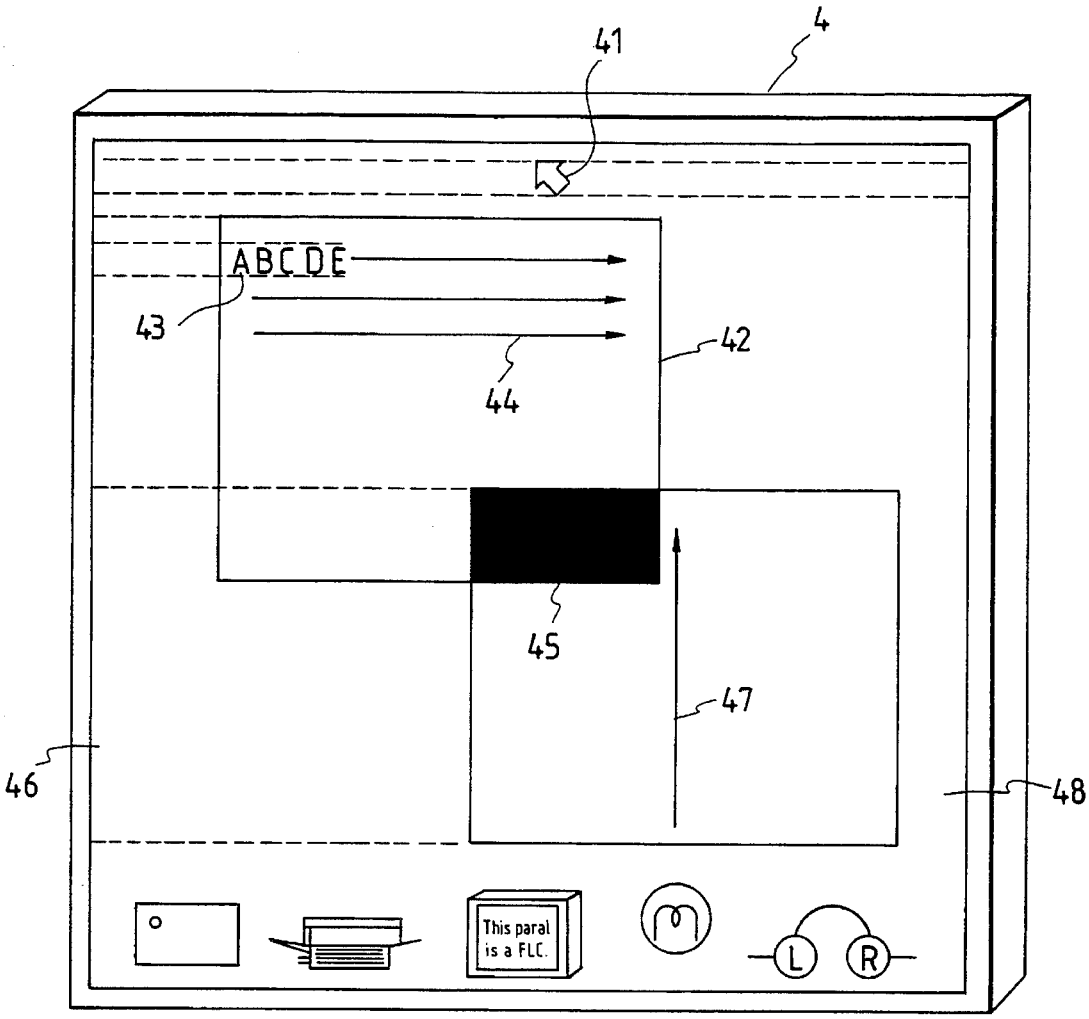
FIG. 5 is a display screen view showing schematically an example of a plurality of graphic events.

FIG. 5 exemplifies a display screen 4 when a plurality of display requests occur for the display of the information on a multi-window and a multi-task system. In FIG. 5, 41 to 48 indicate the following display requests, respectively.

Display request 41: to smoothly move a mouse font obliquely.

Display request 42: to display over an entire screen a portion in which a certain window selected as an active screen is overlapped over the previous window already displayed.

Display request 43: to insert a character by the input from a keyboard.

Display request 44: to move the previous character already displayed (in a direction of the arrow).

Display request 45: to alter the display of the overlap area.

Display request 46: to display a non-active window.

Display request 47: to display the non-active window in scroll.

Display request 48: to display by scanning the entire screen.

The following Table 1 shows the display priority levels in this embodiment of the graphic events corresponding to the display requests 41 to 44 as above listed.

TABLE 1

| Graphic event | Drive mode | Display priority level | Drawing operation |
|---|---|---|---|
| 41 Mouse shift display | Partial rewrite | Highest level | |
| 42 Active window area on | | | Logical access area |
| 43 Character insertion display | Partial rewrite | 2-nd level | |
| 44 Character shift display | Partial rewrite | 3-rd level | |
| 45 Overlap area display alteration | | | Logical VRAM operation |
| 46 Non-active window area on | | | Logical access area |
| 47 Non-active window scroll display | Partial rewrite | 4-th level | |
| 48 Entire scanning display | Multi-field refresh | Lowest level | |

"Partial rewrite" as indicated in the table is a drive method for scanning only the scanning line in the partial rewrite region, and "multi-field refresh" is a one-frame scanning method (a drive method as described in U.S. Pat. No. 5,058,994) by the scanning of N fields (N=2, 4, 8, . . . ) in the multi-interlace scanning. "Display priority level" is a predesignated order in which in this embodiment, to lay stress on the operativity of the man-machine interface, a graphic event 41 (mouse shift display) is given the highest priority at the top level, and then the graphic events 43, 44, 47 and 48 are given the priority in this order. Also, "drawing operation" represents an internal drawing operation of a graphic processor.

The reason why the mouse shift display is at the highest display priority is that the pointing device is required to reflect an operator's intention to the computer most promptly (in real-time). Next important is the input of characters from the keyboard, which are normally buffered, with the real-time capability being so high but lower than the mouse. The updating of the screen within the window as a result of this key input is not necessarily performed at the same time as the key input, with the key input of line given a higher priority. The display relation between the scroll and the overlap area within other windows may vary depending on the system setting, but naturally can take place under the multi-task, whereby the line scroll is performed for the active window.

In this example, the image display control program as shown in FIG. 3 has a feature of accepting each image display requests 41 to 48 via the communication procedure as shown, and performing the transfer control of the image information to the ferroelectric liquid crystal display (FLDC) 101 as shown in FIG. 1. This image display control program serves to selectively transfer the image information to the display unit 101 synchronously by judging a rewrite region and the drawing process onto the VRAM (image information storing memory) 114 necessary for the rewrite on the basis of the display priority level, when at Least one request for rewriting the content already displayed is generated.

Figure 6:
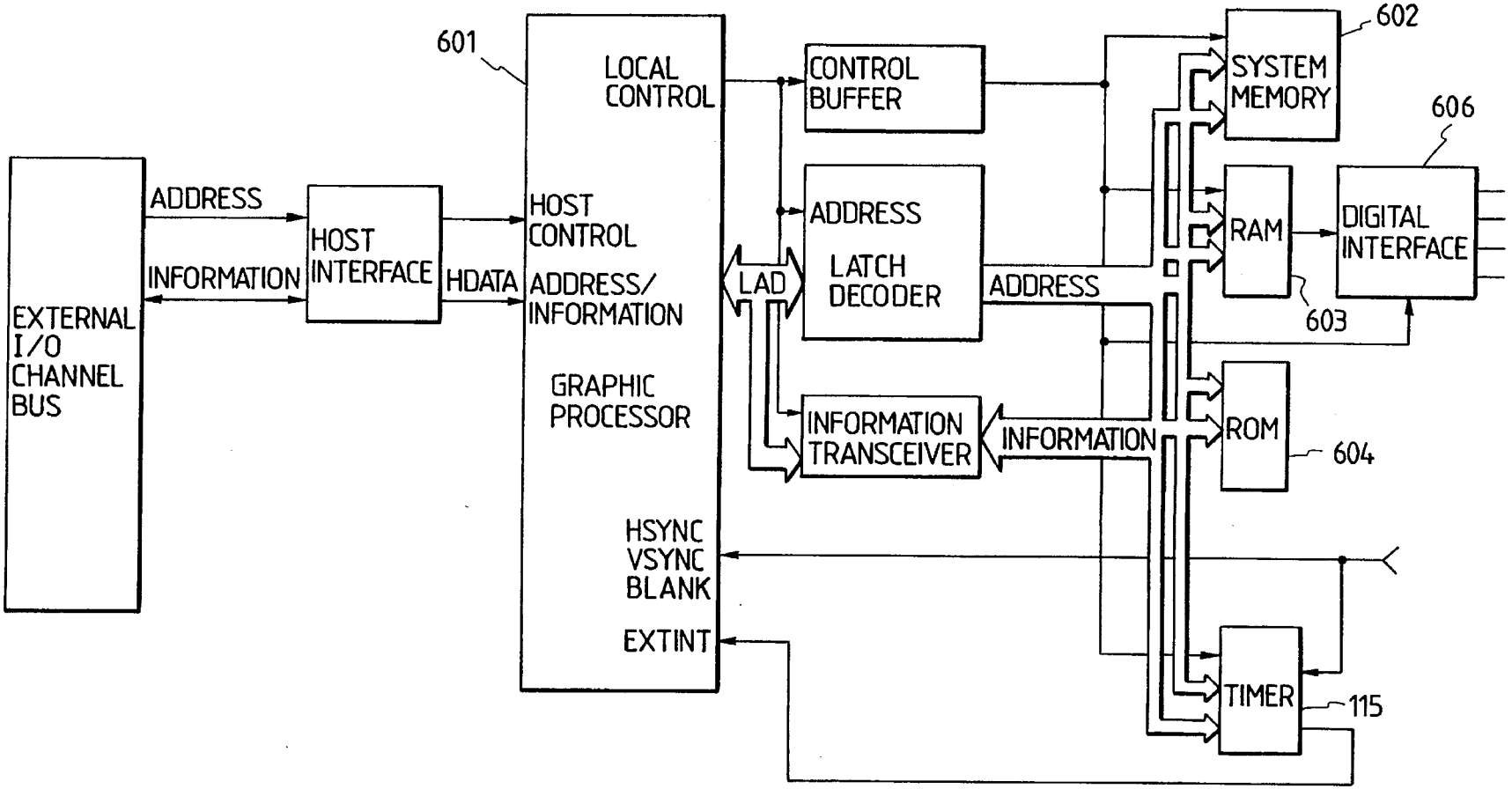
FIG. 6 is a block diagram for explaining an example of a graphic controller 102.

FIG. 6 is a block diagram of the graphics controller 102. The graphics controller 102 for use in this embodiment is characterized in that a graphic processor 601 has a dedicated system memory 602 to perform not only the control of a RAM 603 and a ROM 604, but also the execution and control of a drawing instruction onto the RAM 603, and can program independently the transfer of the information from a digital interface 605 to FLCD controller 102 (FIG. 1), as well as the management for the driving method of FLCD 101 (FIG. 1).

Figure 7:
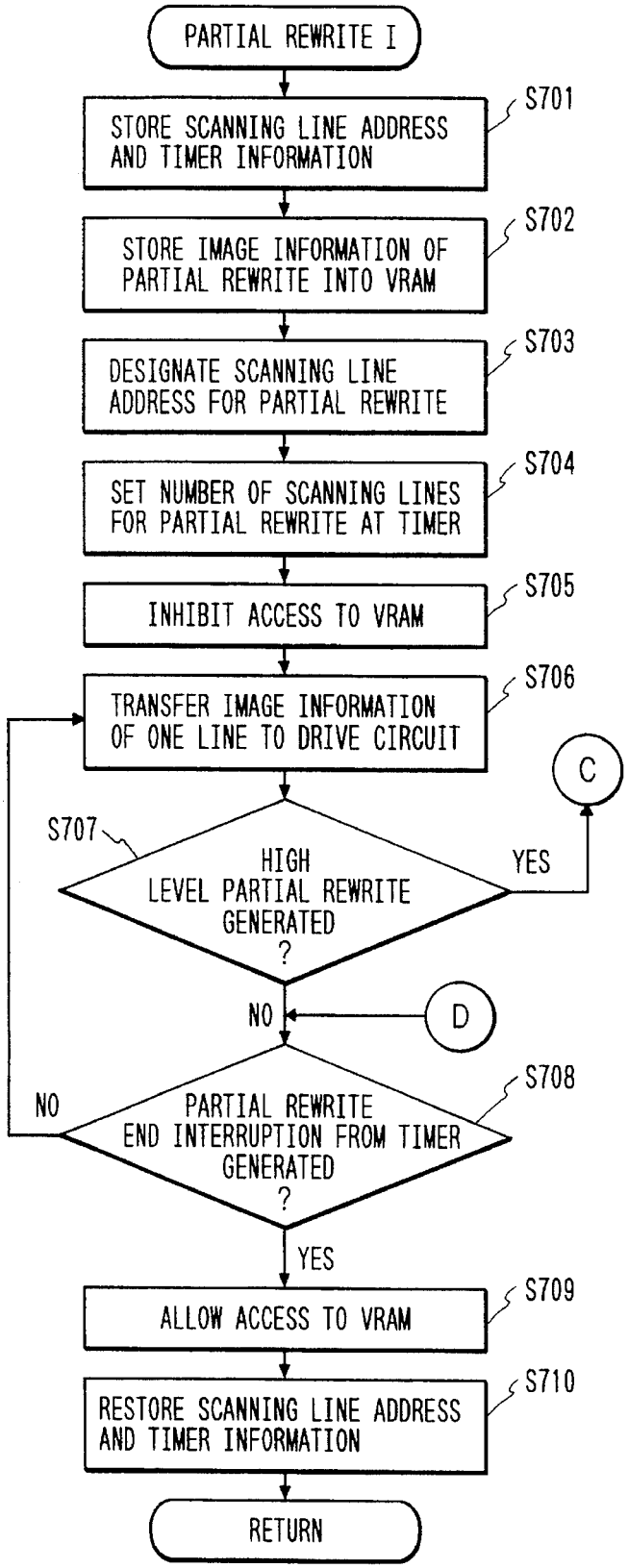
Figure 8:
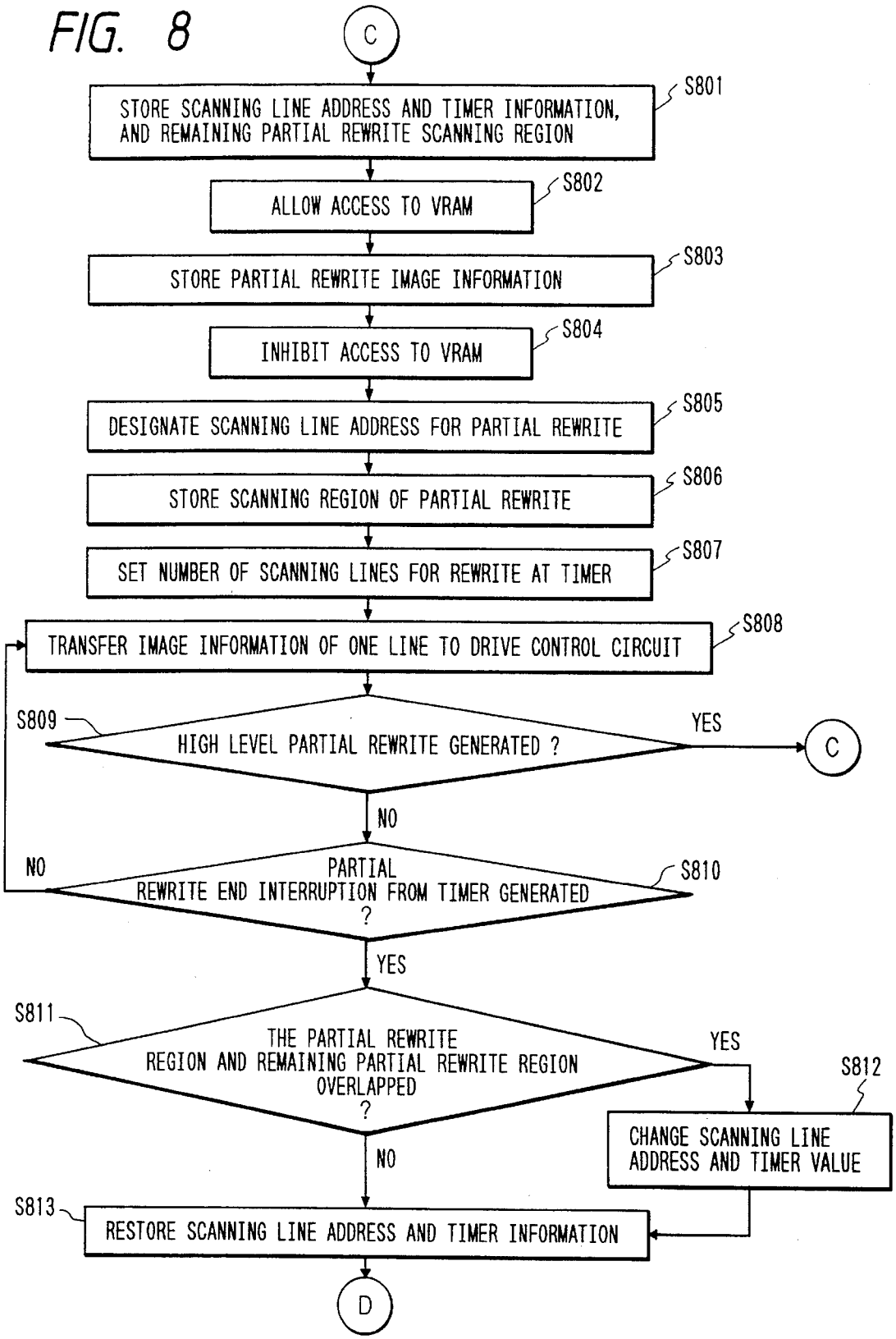

FIGS. 7 and 8, show a partial rewrite algorithm in the device as shown in FIG. 1. In the device as shown in FIG. 1, the display information (with a pointing device or pop-up menu) necessary for the partial rewrite on the ferroelectric liquid crystal display is preregistered in GCPU 112, and when the partial rewrite is judged to be necessary for the information from the host CPU 100, a partial rewrite routine is entered as shown in FIGS. 7 and 8. The partial rewrite routine first saves the scanning line address immediately before branching and the number of remaining scanning lines as the information to return to a refresh routine into a register prepared within the GCPU 112 (S701). Then, the image information associated with the partial rewrite is stored in the VRAM 114 (S702), but as the host CPU 100 is permitted to access the VRAM 114 via the GCPU 112, the GCPU 112 manages the store start address and the storage region of the image information associated with the partial rewrite onto the VRAM 114 (S703).

After the storing of the image information onto the VRAM 114 is terminated, the number of partial rewrite scanning lines is set to a timer 115 (S704) to make the synchronization between the storing of the image information onto the VRAM 114 and the partial rewrite scanning of the display panel 103. The timer 115 counts down the number of set lines for each scanning of one line, and generates an interrupt to the GCPU 112 upon termination of the number of partial rewrite scanning lines. Also, the GCPU 112 performs the processing by inhibiting or permitting the access to the VRAM 114 depending on the type of the image information until an interrupt occurs from the timer (S705, S709, S802, S804).

FIG. 8 is a flowchart in which the access to the VRAM 114 is inhibited. When a partial rewrite request with a higher priority level occurs during the partial rewrite process (S707, S809), the partial rewrite being currently executed is temporarily suspended, and the partial rewrite request with the higher priority level is started. With a conventional method, after the higher priority partial rewrite is terminated, the scanning is restarted at the next line at which the previous partial rewrite is suspended. In this embodiment, both the information in the remaining scanning range of the suspended partial rewrite and the information in the scanning range of the higher priority partial rewrite are stored (S801). This scanning range information is compared when the higher priority partial rewrite is terminated (S811), and if there is any portion of the higher priority partial rewrite already scanned which includes the remaining scanning range of the suspended partial rewrite, the scanning line address and the timer value are updated to omit that portion already scanned (S812) .

FIG. 10 is an example of the partial rewrite in the conventional method, and FIG. 11 is an example of the partial rewrite in the embodiment. The figure shows an instance where a mouse partial rewrite takes place during a scroll partial rewrite, with the priority level of the mouse being higher than that of the scroll. In particular, FIG. 11 shows how the duplicate partial rewrite is eliminated by the use of this embodiment, so that the partial rewrite process can be terminated more promptly.

Figures 10A, 10B, 10C, 10D, 10E, 10F:
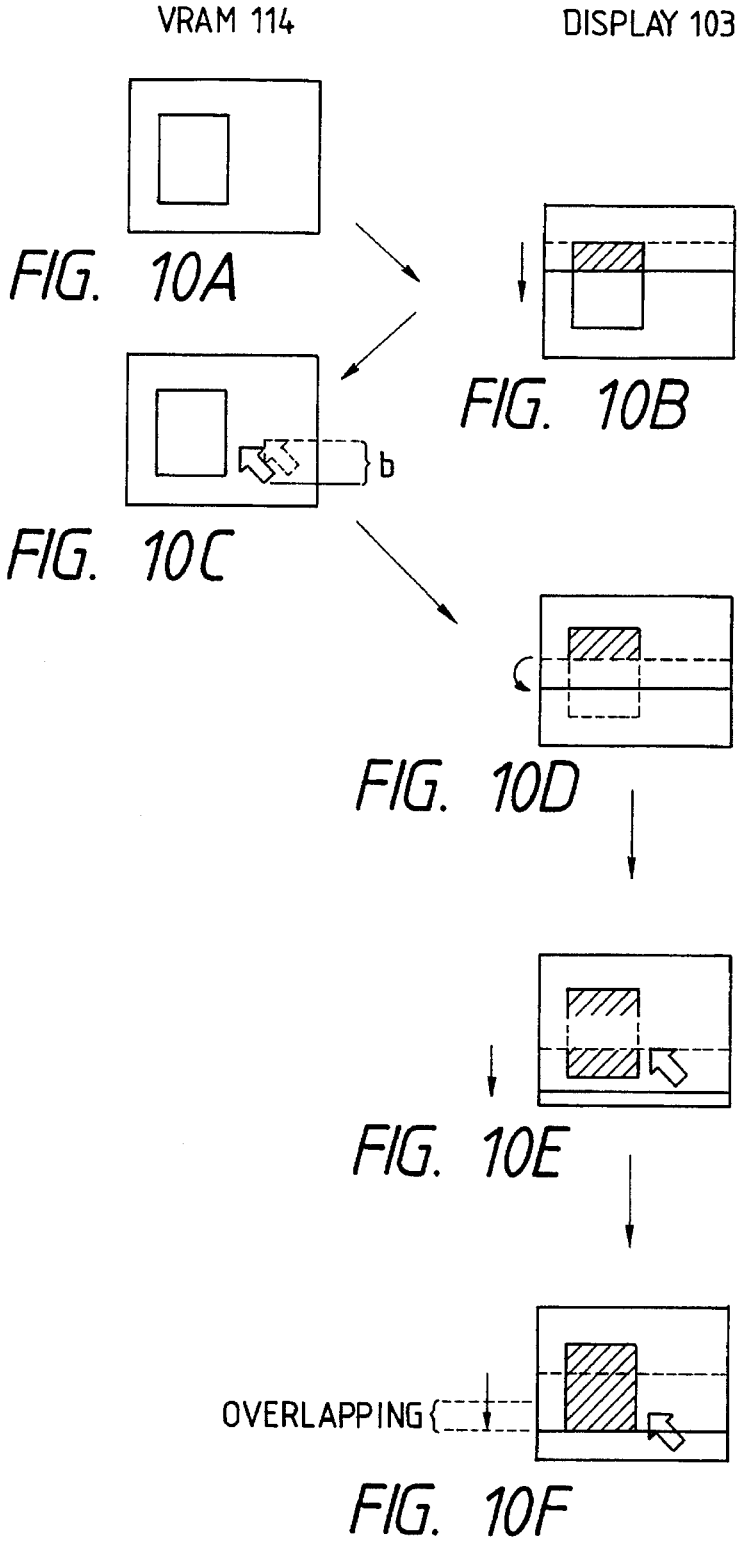

In the conventional example, if a scroll partial rewrite request occurs, as shown in FIG. 10, the scroll information is expanded over the VRAM 114 (FIG. 1) (see FIG. 10A), and the partial rewrite for the scroll display is started on the display 103 (FIG. 1) (see FIG. 10B). At this point, if a mouse partial rewrite request (mouse shift) at a higher priority level than the scroll occurs (FIG. 10C), the mouse on the VRAM 114 is moved (FIG. 10C), whereupon the scroll partial rewrite at a lower priority level is temporarily suspended on the display 103, and the mouse partial rewrite at the higher priority level is started (FIG. 10D). With this mouse partial rewrite, the mouse after being shifted is displayed on the display 103, and in a scanned range with this mouse shift display, a part of the scroll is also displayed (FIG. 10E). If the mouse partial rewrite is terminated, the remaining portion of the scroll partial rewrite is executed (FIG. 10F). Since that remaining portion is partly involved in the display with the mouse partial rewrite (see FIG. 10E), the duplicate scanning is performed so that it takes more time than necessary for the partial rewrite process to be achieved.

Figures 11A, 11B, 11C, 11D, 11E, 11F:
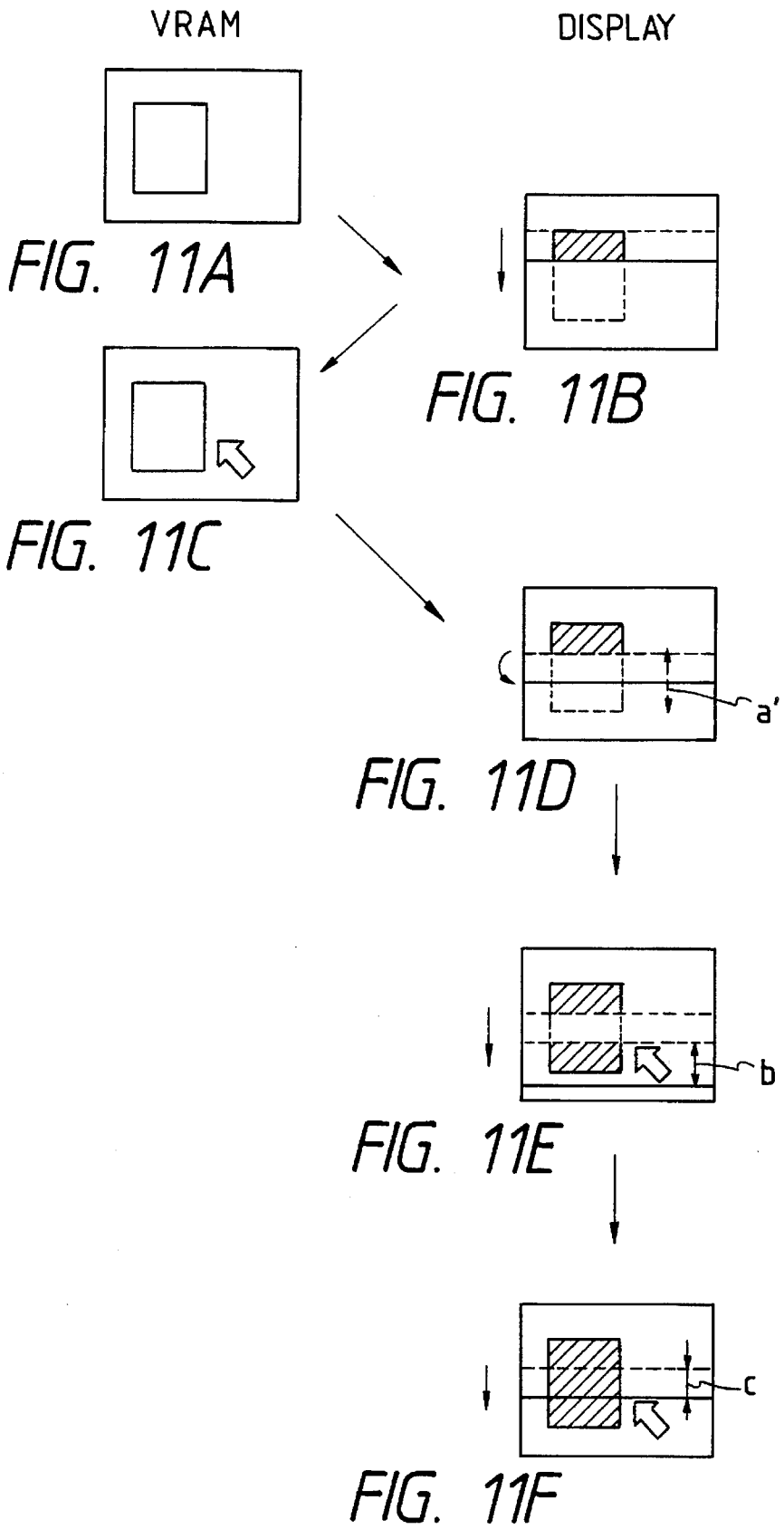
FIGS. 11 and 13 are explanation views showing a display example according to the embodiment of the present invention.

On the other hand, in this embodiment, the data expansion over the VRAM 114 and the display on the display unit 103 are performed exactly in the same manner as in the conventional embodiment, until a scroll partial rewrite request occurs, and further a mouse partial rewrite request occurs and is executed, as shown in FIG. 11 (see FIGS. 11A to 11E). However, a remaining range a of the scroll partial rewrite (FIG. 11D) and a range b of the mouse partial rewrite (FIG. 11E) are stored, as indicated at S801 in FIG. 8, before the start of the mouse partial rewrite, and only a portion of the range a excluding the range b is rewritten as the continuing process of the scroll partial rewrite, as indicated at S811 to S813 in FIG. 8, after the termination of the mouse partial rewrite (FIG. 11F). Thereby, when the mouse partial rewrite scanning range b and the remaining scanning range a of the scroll partial rewrite are overlapped, the duplicate scanning which may occur in the conventional example can be eliminated, so that the partial rewrite process can be terminated more rapidly. In this embodiment, when there occurs a partial rewrite request having the same or lower priority level during the partial rewrite process, the partial rewrite being currently executed or waiting is completely terminated, as in the conventional example, and then the display content is changed by a refresh process or new partial rewrite process.

Note that this embodiment can be modified so that the access to the RAM 114 is permitted during the partial rewrite process. FIG. 9 is a flowchart in which the access to the RAM 114 is permitted. FIG. 9 corresponds to FIG. 7 as previously described, and FIG. 8 can be commonly used in this embodiment. Note that in this embodiment, S802 and S804 can be omitted.

In FIG. 9, when a partial rewrite request at a higher priority level occurs (S906) during the partial rewrite (S905 to S912), the partial rewrite process of FIG. 8 is executed so that the duplicate partial rewrite can be eliminated as when the access to the VRAM 114 is inhibited. This embodiment is particularly featured in the instance where the partial rewrite request having the same priority level occurs during the partial rewrite (S908). In the conventional method, the access to the VRAM 114 was permitted even if the same level partial rewrite request might occur, until the partial rewrite being currently executed was terminated, but the partial rewrite display was not made. However, in this embodiment, the partial rewrite scanning range information is stored for each of the partial rewrite requests at the same priority arising until the partial rewrite being currently executed is terminated. This scanning range information is adjusted by a comparison with the current scanning position, when stored, and if there is any portion thereof to be displayed by the partial rewrite being currently executed, it is stored except for that portion so as not to be duplicated (S909 to S911). And after the partial rewrite being currently executed is terminated, the partial rewrite is performed by scanning the scanning range which has been stored at a time (S912 to S915). In this way, when the range information may be overlapped, the adjustment is also made in this case to eliminate the duplication.

FIGS. 12 and 13 show the examples of the partial rewrite when the access to the VRAM 114 is permitted during the partial rewrite, respectively. FIG. 12 is a conventional example, and FIG. 13 is an example of this embodiment. These figures show how the character is displayed in the order of "A, B, C". If a character "A" is expanded over the VRAM 114 (see FIG. 12A), the partial rewrite is started (FIG. 12B). Since the access to the VRAM 114 is permitted until this partial rewrite is terminated, a character "B" is expanded over the VRAM 114 (FIG. 12C), so that the same level partial rewrite request is generated. In such a case, with the conventional method, the partial rewrite can not be performed (or ignored), whereby the character "B" expanded over the VRAM 114 is rewritten in the partial rewrite process of the character "A". Accordingly, the character "B" is displayed from halfway as shown in FIGS. 12D to 12F, with a part thereof only displayed. In FIG. 12E, a character "C" is further expanded over the VRAM 114, and the partial rewrite process of "A" is then terminated. Since the character "C", like the character "B", is involved in the same level partial rewrite as the display of character "A", the partial rewrite request is ignored, so that a part of the character "C" corresponding to a scanning range occurring from the time when the partial rewrite request of "A" is generated to the time when the partial rewrite request of "C" is generated is not also displayed. That is, the characters "B" and "C" are not completely displayed (see FIG. 12G). In order to display the characters "B" and "C" completely, the rewrite is required to be newly made.

Figures 13A, 13B, 13C, 13D, 13E, 13F, 13G, 13H:
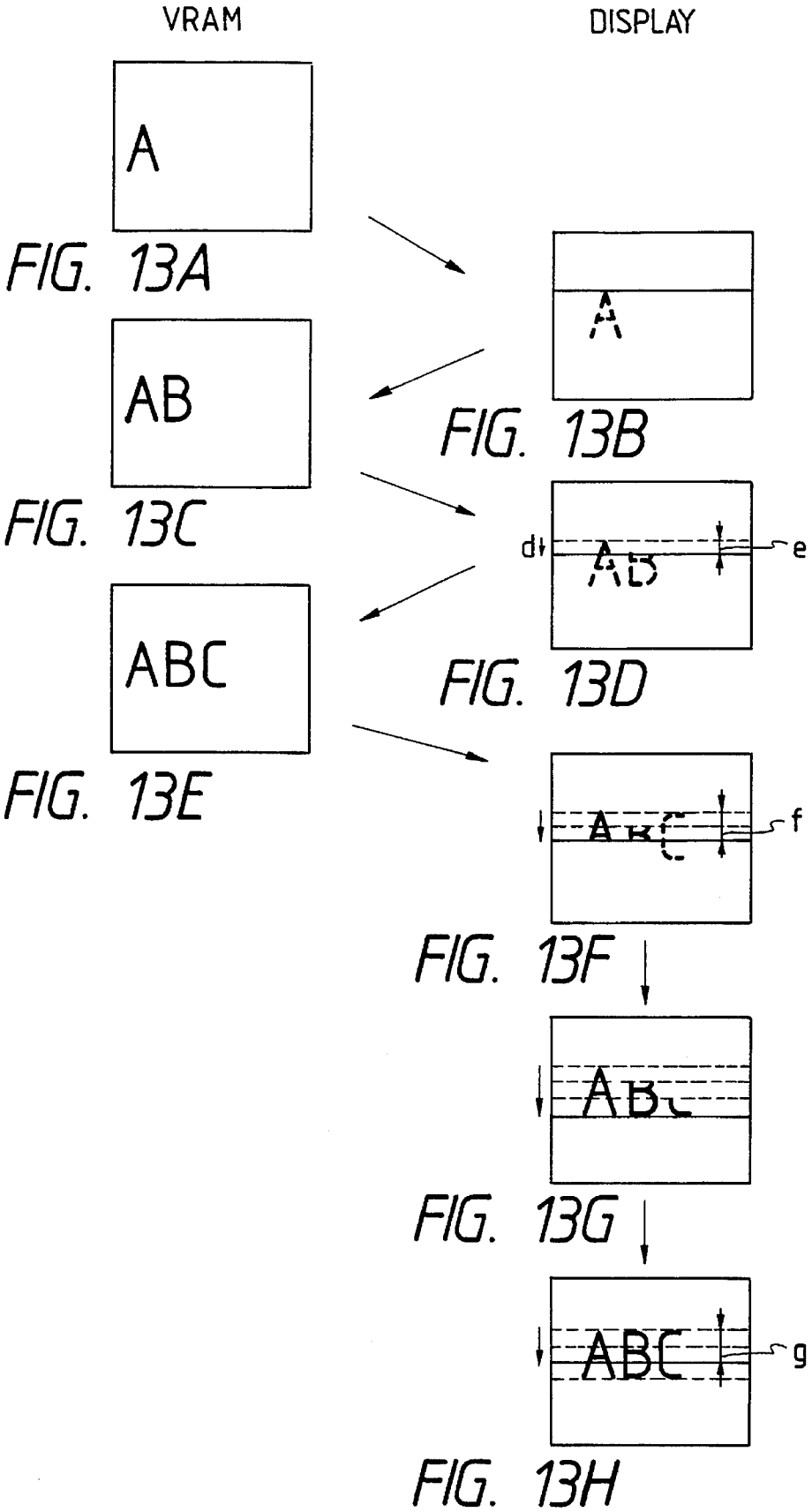

In this embodiment, the data expansion over the VRAM 114 as shown by A to G in FIG. 13 and the display on the display unit 103 are performed exactly in the same way as in the conventional example (FIGS. 12A to 12G). In this embodiment, however, if there is the same level partial rewrite request (S908 in FIG. 9), the current scanning position and the partial rewrite scanning range information are stored (S909 to S911 in the same figure), and a part not rewritten by the partial rewrite of the character "A", notwithstanding the same level partial rewrite request, is further rewritten, after the partial rewrite of the character "A" has been terminated, so that the undisplayed part in FIGS. 13A to 13G is further displayed (FIG. 13H). That is, since the scanning position at which a partial rewrite request of the character "B" is generated is d in FIG. 13, a portion below the scanning line d of the character "B" can be displayed by the partial rewrite being currently executed (see FIGS. 13D to 13G). Since the storage of the scanning range information is made except for a portion displayed by the current partial rewrite, the stored range is a range of e. And if a partial rewrite request of the character "C" is generated, the stored range is a range f. If the partial rewrite of the character "A" is terminated, the adjustment for the respective partial rewrite ranges is made to eliminate the duplication, and finally the partial rewrite range is a range of g (equivalent to f in this embodiment), which is then displayed by the partial rewrite as shown in FIG. 13H.

In the information processing system of this embodiment, the scanning range information for respective partial rewrite request is stored, and further the current scanning position information is acquired and adjusted by a comparison, whereby the duplicate partial rewrite can be avoided and even if partial rewrites at the same priority level occur in succession, the partial rewrite display can be made rapidly.

FIG. 14 shows the driving waveforms in a multi-interlace drive method for use in this embodiment. The same figure shows a ¼ interlace example with one frame (screen) constituted of four times of the vertical scanning (field), in which a scanning selection signal $S_{4n-3}$ (n=1, 2, 3, . . . ) to be applied to the (4n - 3)-th scanning electrode, a scanning selection signal $S_{4n-2}$ to be applied to the (4n - 2)-th scanning electrode, a scanning selection signal $S_{4n-1}$ to be applied to the (4n - 1)-th scanning electrode, and a scanning selection signal $S_{4n}$ to be applied to the 4n-th scanning electrode in the (4M-3)-th field $F_{4M-3}$, the (4M - 2)-th field $F_{4M-2}$, the (4M - 1)-th field $F_{4M-1}$, and the 4M-th field $F_{4M}$ (herein, one field means one vertical scanning period, where M=1, 2, 3, . . . ) are shown respectively. As shown in FIG. 14, the scanning selection signal $S_{4n-3}$ has opposite polarities of the voltage (with reference to the scanning non-selection signal voltage) at the same phase in the (4M-3)-th field $F_{4M-3}$ and the (4M -1)-th field $F_{4M-1}$, and is not scanned in the (4M - 2)-th field $F_{4M-2}$ and the 4M-th field $F_{4M}$. The scanning selection signal $S_{4n-1}$ is similar. Further, the scanning selection signals $S_{4n-3}$ and $S_{4n-1}$ applied within a period of one field have different voltage waveforms, i.e., opposite voltage polarities at the same phase.

Similarly, the scanning selection signal $S_{4n-2}$ has opposite polarities of the voltage (with reference to the scanning non-selection signal voltage) at the same phase in the (4M - 2)-th field $F_{4M-2}$ and the 4M-th field $F_{4M}$, and is not scanned in the (4M - 3)-th field $F_{4M-3}$ and the (4M - 1)-th field $F_{4M-1}$. And the scanning selection signal $S_{4n}$ is similar. Further, the scanning selection signals $S_{4n-2}$ and $S_{4n}$ applied within a period of one field have different voltage waveforms, i.e., opposite voltage polarities at the same phase.

In the scanning driving waveforms as shown in FIG. 14, the phase to cause the screen to rest entirely (for example, a zero voltage is applied to all the pixels constituting a screen) is provided thirdly, with the third phase of the scanning selection signal set at a zero voltage (the same level as the scanning non-selection signal voltage).

Figure 15:
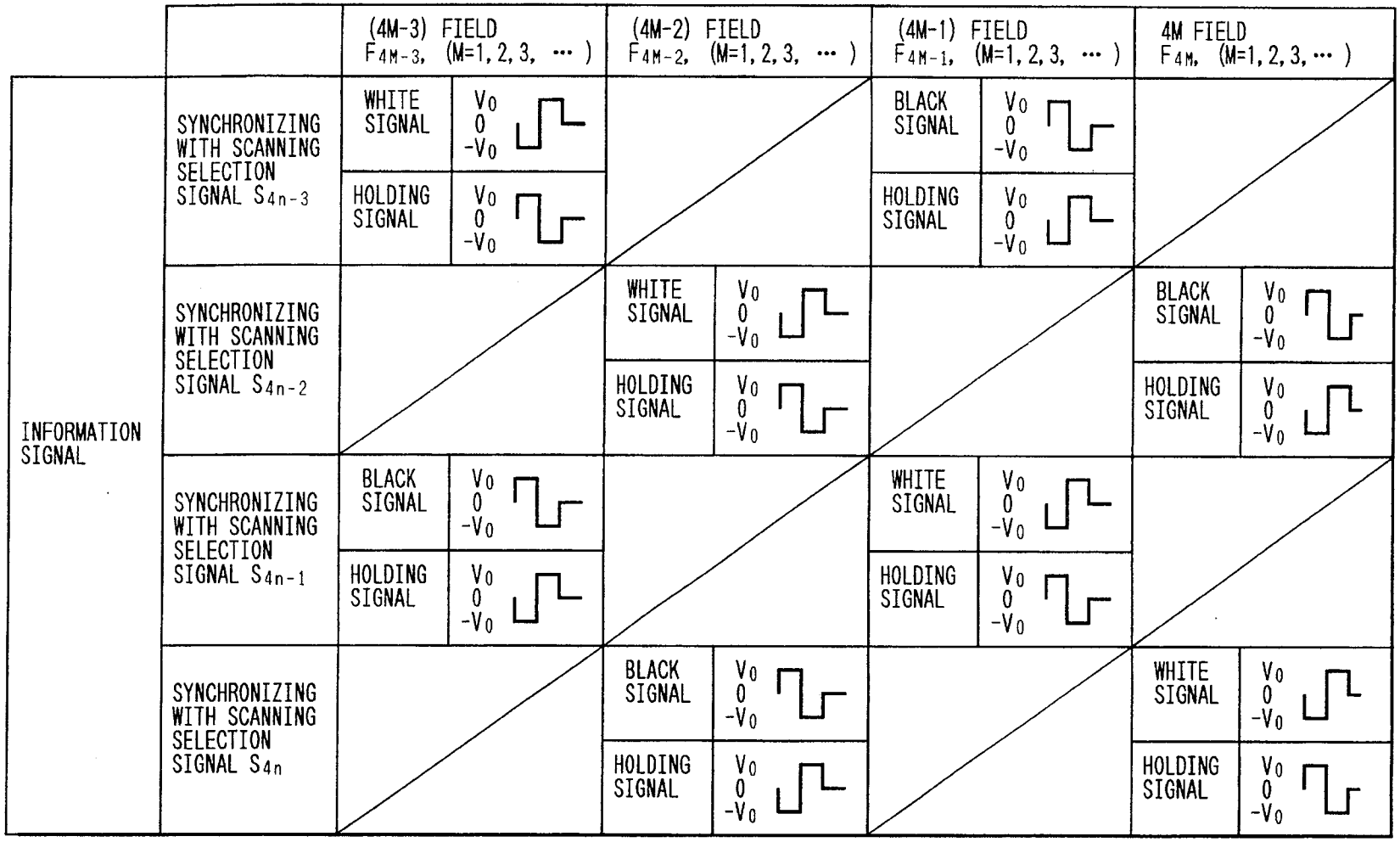

In FIG. 15, the information signal to be applied to the signal electrode in the (4M - 3)-th field $F_{4M-3}$ is such that a white signal (a voltage 3 Vo exceeding a threshold voltage of the ferroelectric liquid crystal at the second phase in the synthesis with the scanning selection signal $S_{4n-3}$ is applied to form a white pixel) or a holding signal (a voltage±Vo smaller than a threshold voltage of the ferroelectric liquid crystal in the synthesis with the scanning selection signal $S_{4n-3}$ is applied to the pixel) is selectively applied for the scanning selection signal $S_{4n-3}$, while a black signal (a voltage −3 Vo exceeding a threshold voltage of the ferroelectric liquid crystal at the second phase in the synthesis with the scanning selection signal $S_{4n-1}$ is applied to form a black pixel) or a holding signal (a voltage±Vo smaller than a threshold voltage of the ferroelectric liquid crystal in the synthesis with the scanning selection signal $S_{4n-1}$ is applied to the pixel) is selectively applied for the scanning selection signal $S_{4n-1}$. And the scanning non-selection signal is applied to the (4n - 2)-th and the (4n)-th scanning electrodes, and thus the information signal is directly applied.

In the (4M - 2)-th field $F_{4M-2}$ following the writing of the (4M - 3)-th field $F_{4M-3}$ as above described, the information signal to be applied to the signal electrode is such that the black signal or the holding signal as above described is selectively applied to the scanning selection signal $S_{4n-2}$, while the white signal or the holding signal as above described is selectively applied to the scanning selection signal $S_{4n}$. And the scanning non-selection signal is applied to the (4n - 3)-th and the (4n - 1)-th scanning electrodes, and thus the information signal is directly applied.

Also, in the (4M - 1)-th field $F_{4M-1}$ following the (4M - 2)-th field $F_{4M-2}$, the information signal to be applied to the signal electrode is such that the black signal or the holding signal as above described is selectively applied to the scanning selection signal $S_{4n-3}$, while the white signal or the holding signal as above described is selectively applied to the scanning selection signal $S_{4n-1}$. And the scanning non-selection signal is applied to the (4n - 2)-th and the (4n)-th scanning electrodes, and thus the information signal is directly applied.

Also, in the 4M-th field $F_{4M}$ following the (4M - 1)-th field $F_{4M-1}$, the information signal to be applied to the signal electrode is such that the black signal or the holding signal as above described is selectively applied to the scanning selection signal $S_{4n-2}$, while the white signal or the holding signal as above described is selectively applied to the scanning selection signal $S_{4n}$. And the scanning non-selection signal is applied to the (4n - 3) -th and the (4n - 1)-th scanning electrodes, and thus the information signal is directly applied.

Figure 16:
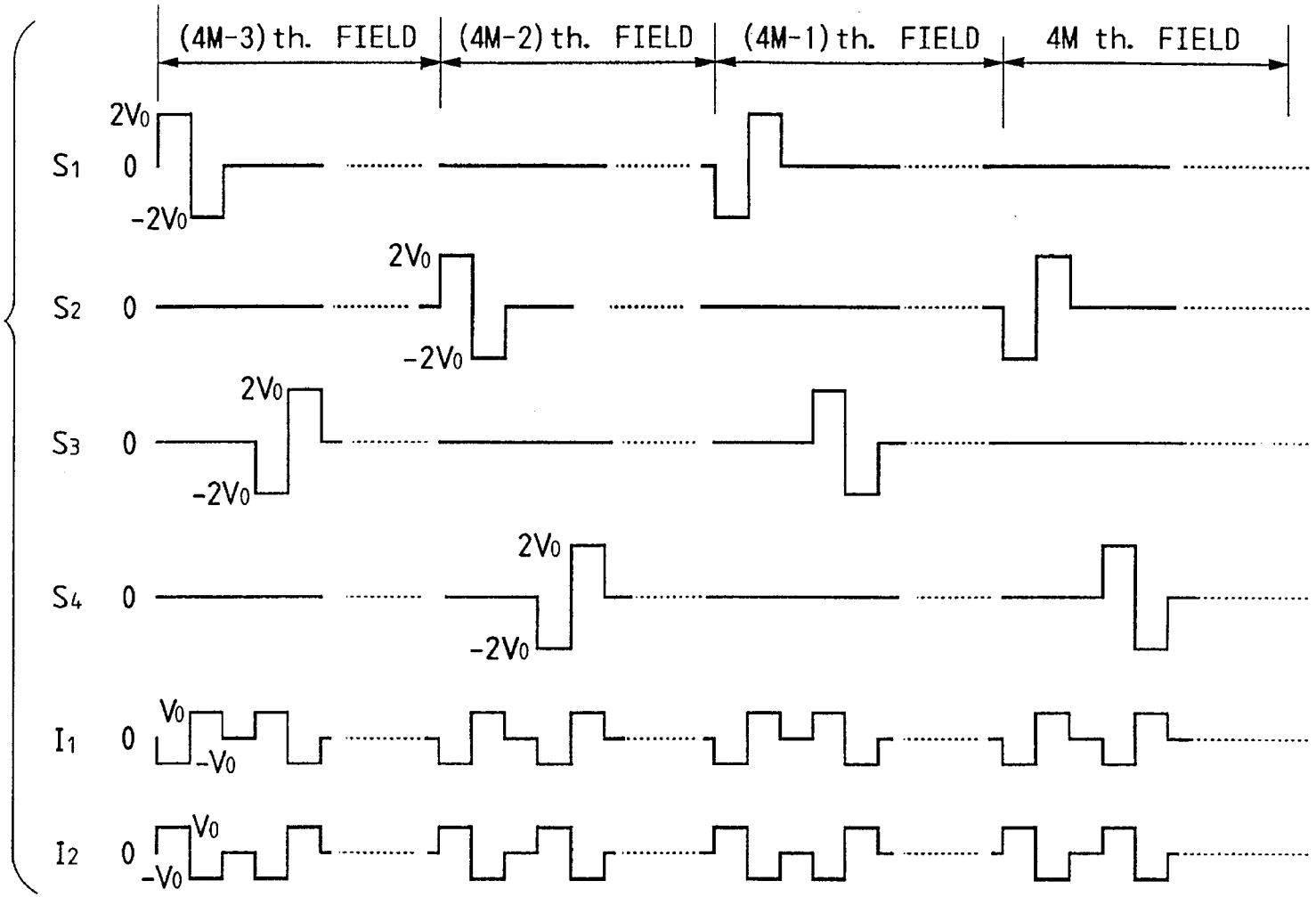
FIGS. 16 to 18 are timing charts for use in this embodiment.
Figure 17:
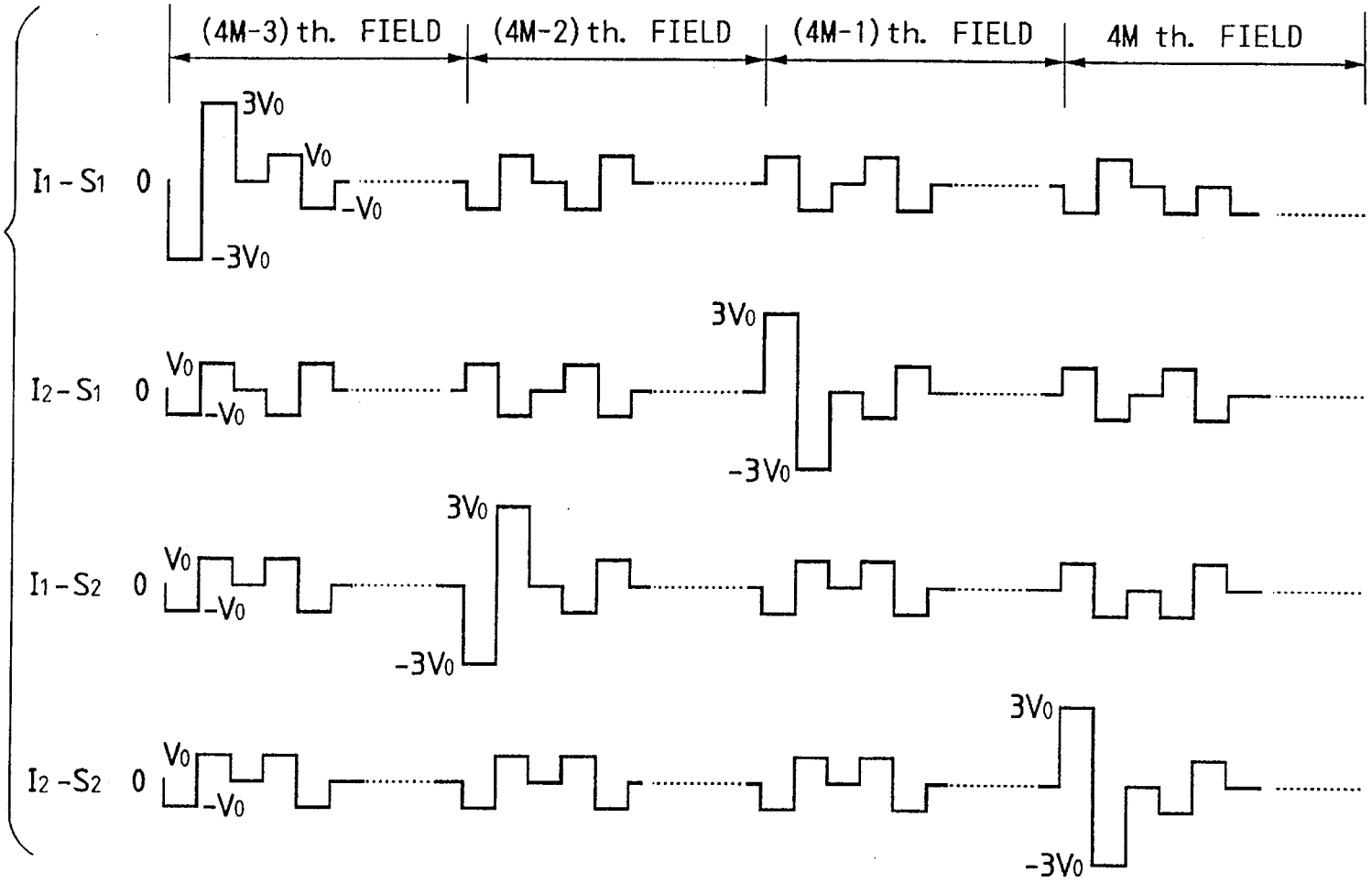
Figure 18:
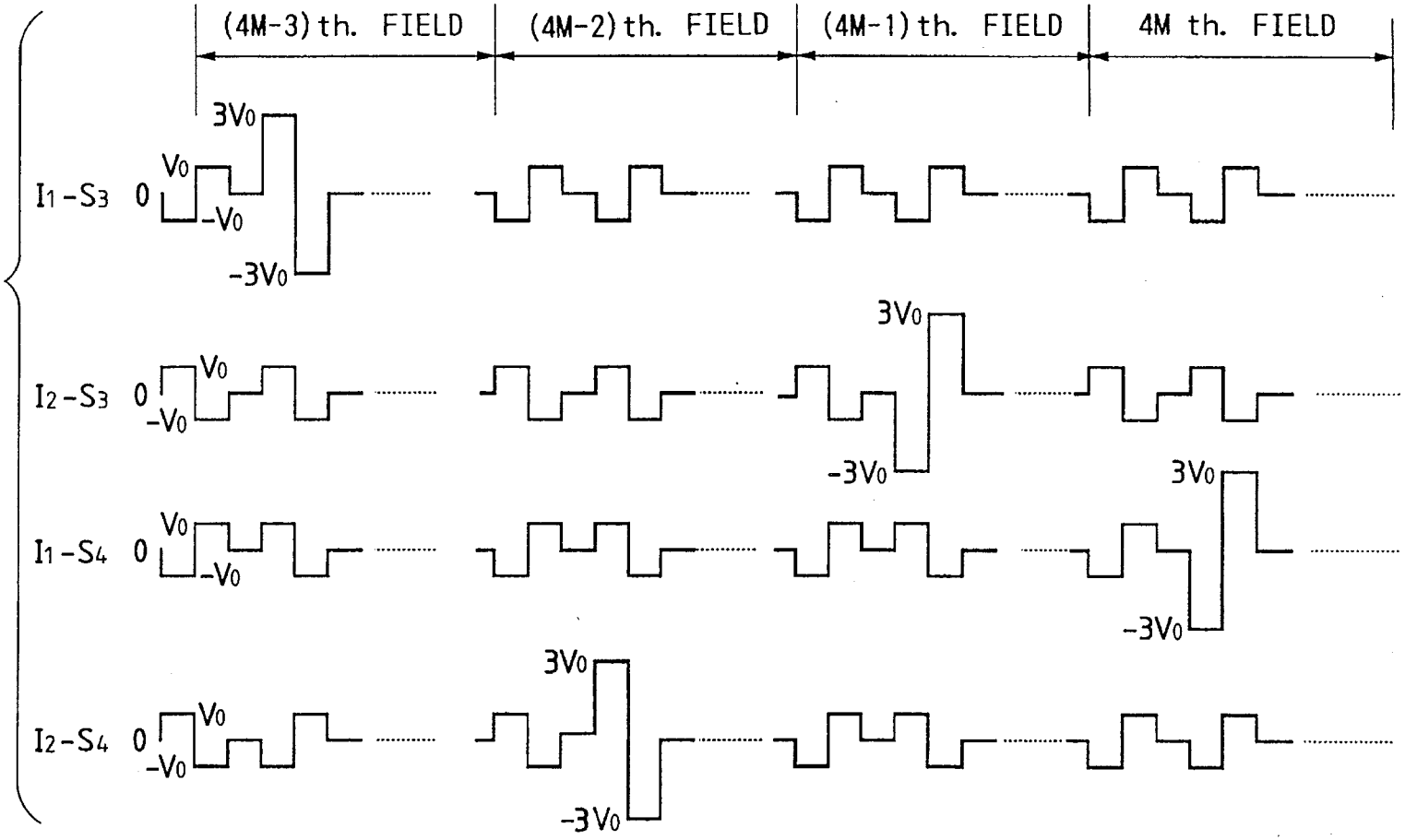
Figure 19:
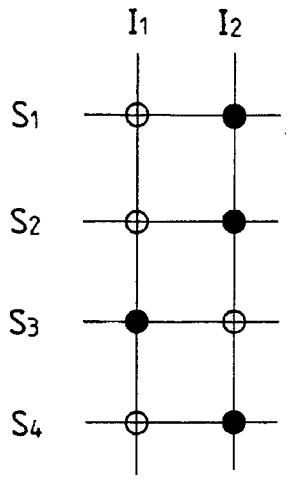
FIG. 19 is a schematic view showing a display state of the pixel as shown by the timing chart.

FIGS. 16 to 18 show the timing charts when a display state as shown in FIG. 19 is written with the driving waveforms as shown in FIGS. 14 and 15. In FIG. 19, ○ indicates a white pixel, and ● indicates a black pixel. In FIG. 17, $I_1$–$S_1$ is a time series waveform of the voltage applied to the intersection between the scanning electrode $S_1$ and the signal electrode $I_1$. $I_1$-$S_2$ is a time series waveform of the voltage applied to the intersection between the scanning electrode $S_1$ and the signal electrode $I_2$. Similarly, $I_1$-$S_2$ is a time series waveform of the voltage applied to the intersection between the scanning electrode $S_2$ and the signal electrode $I_1$, $I_2$-$S_2$ is a time series waveform of the voltage applied to the intersection between the scanning electrode $S_2$ and the signal electrode $I_2$.

Note that the present invention is not limited to the above-described embodiment, but may be accomplished by appropriate modification. For example, the drive waveform as above described is an example in which the scanning is performed for every four lines, but may be performed for every five, six, seven, or preferably eight lines. Also, the scanning selection signal may have a waveform with its polarity reversed for every field as shown in FIG. 14, or the same polarity for every field.

Figure 20:
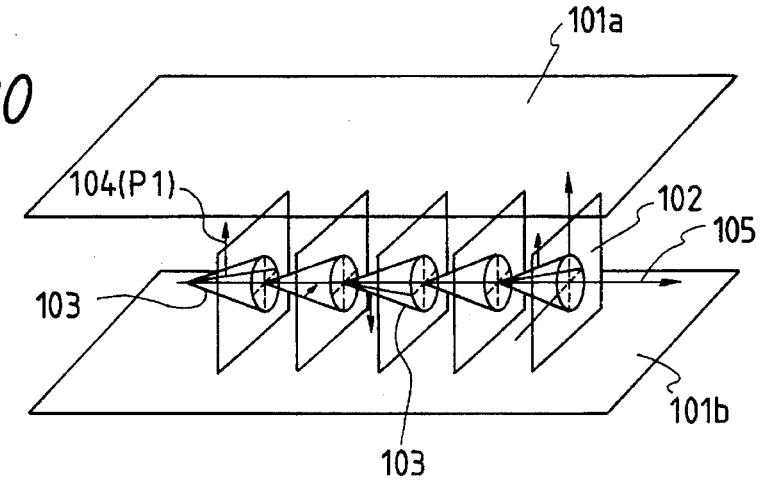
FIGS. 20 and 21 are schematic perspective views for explaining a ferroelectric liquid crystal cell for use in this embodiment, respectively.
Figure 21:
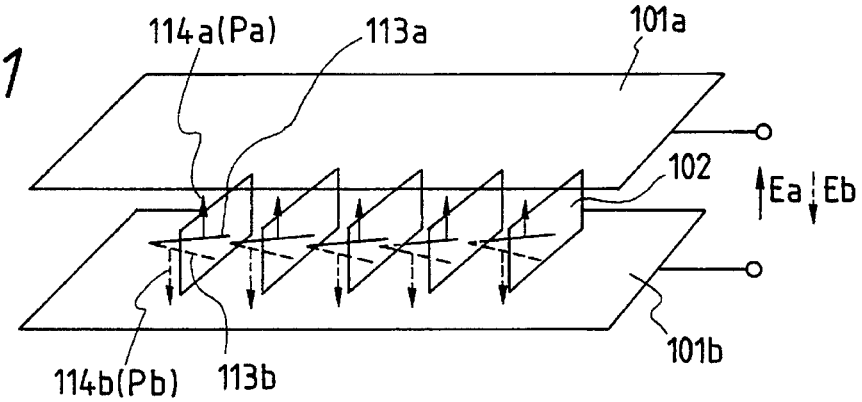

FIG. 20 depicts an example of a ferroelectric liquid crystal cell suitably used as the liquid crystal panel 103 of FIG. 1. In the same figure, 101*a* and 101*b* are substrates (glass plates) coated with transparent electrodes made of $In_2O_3$, $SnO_2$ or ITO (indium-tin-oxide), and between the substrates are enclosed a liquid crystal of SmC* phase in which a liquid molecular layer 102 is oriented perpendicularly to the glass plane. A line 103 as indicated by the hold line indicates a liquid crystal molecule 103, which has a dipole moment (P ⊥) 104 in a direction orthogonal to the molecule. If a voltage exceeding a certain threshold value is applied between the electrodes on the substrates 101*a* and 101*b*, the helical structure of liquid crystal molecule 103 is loosened, and liquid molecules 103 can be oriented so that all the dipole moments (P ⊥) may be in a direction of the electric field. The liquid crystal molecule 103 has a slender shape, and shows the refractive index anisotropy in its major axis direction and its minor axis direction. Accordingly, it will be readily understood that, for example, if polarizers are arranged in a positional relation of cross Nicol above and under the glass plane, a liquid crystal optical modulation element having the optical characteristics variable by the applied voltage polarity results. Further, when the liquid crystal cell is made sufficiently thin (e.g., 1 μm), the helical structure of the liquid crystal molecule is loosened even in a state without application of the electric field as shown in FIG. 21, with its dipole moment Pa or Pb being placed in either an upwardly directed (114*a*) or downwardly directed (114*b*) state. If an electric field Ea or Eb having a different polarity exceeding a certain threshold value is applied to such a cell for a predetermined time, as shown in FIG. 21, the dipole moment is directed in an upward direction 114*a* or downward direction 114*b* depending on an electric field vector of the electric field Ea or Eb, in accordance with which the liquid crystal molecule is oriented to either a first stable state 113*a* or a second stable state 113*b*.

There are two advantages of using such a ferroelectric liquid crystal as the optical modulation element. Firstly, the response speed is quite faster, and secondly the orientation of the liquid crystal has a bistable state. Referring to FIG. 21, the second point means that if the electric field Ea is applied, the liquid crystal is oriented to a stable state 113*a*, and this state is stable even if the electric field is cut off. Also, if the electric field Eb in a reverse direction is applied, the liquid crystal is oriented to a second stable state 113*b*, with the direction of the molecules changed, but even if the electric field is cut off, this state is held. As long as the electric field Ea to be applied exceeds a certain threshold value, the liquid crystal is still maintained in a respective orientation state. In order to effectively realize such a fast response speed and the bistability, the cell is preferably as thin as possible, and typically in a range from 0.5 μm to 20 μm, and preferably in a range from 1 μm to 5 μm.

As above described, according to the present invention, in performing the partial rewrite onto a display unit having a memory property such as a ferroelectric liquid crystal display, the scanning range information for respective partial rewrite request is stored, and further the current scanning position information is acquired, and adjusted by a comparison, whereby the duplicate partial rewrite can be avoided, so that a faster partial rewrite process is enabled. Further, since a plurality of partial rewrite requests can be put together into one partial rewrite, the faster partial rewrite display can be realized even when the partial requests at the same priority level occur in succession.

What is claimed:

1. A display method comprising the steps of:

initiating a first partial rewriting on a display for displaying a first graphic event having a display priority;

stopping the first partial rewriting remaining non-rewritten area on the display wherein the partial rewriting is not completed in response to a display instruction of a second graphic event having a display priority that is higher than the display priority of the first graphic event;

performing the second partial rewriting on the display for displaying the second graphic event partially overlapping with the first graphic event on the display; and after completing the second partial rewriting, comparing an overlapping area between the first and second partial rewrites with the non-rewritten area and performing the partial rewrite of the non-rewritten area except for the overlapping area.

2. A display device comprising:

display means having a plurality of scanning lines for displaying display information;

a driver for driving said display means;

a memory for storing display information; and a controller for controlling said driver based on the display information stored in said memory, said controller performing the steps of:

initiating a first partial rewriting on said display means for displaying a first graphic event having a display priority;

stopping the first partial rewriting remaining non-rewritten area wherein the partial rewriting is not completed in response to a display instruction of a second graphic event having a display priority higher than the display priority of the first graphic event;

performing the second partial rewriting on said display means for displaying the second graphic event partially overlapping with the first graphic event on said display means;

after completing the second partial rewriting, comparing the overlapping area between the first and second partial rewrites with the non-rewritten area; and changing a scanning line address to perform the partial rewrite of an area of the non-rewritten area except for the overlapping area.

3. A display device according to claim 2, wherein said display means has a memory function.

4. A display device according to claim 3, wherein said display means includes an active matrix type liquid crystal display.

5. A display device according to claim 2, wherein said display means includes a ferroelectric liquid crystal display.

6. A controlling device for controlling a display device having a plurality of scanning lines, comprising:

a memory for storing display information; and a controller for controlling a driver based on the display information stored in said memory, said controller performing the steps of:

initiating a first partial rewriting on the display device for displaying a first graphic event having a display priority;

stopping the first partial rewriting remaining non-rewritten area wherein the partial rewriting is not completed in response to a display instruction of a second graphic event having a display priority higher than the display priority of the first graphic event;

performing the second partial rewriting on the display device for displaying the second graphic event partially overlapping with the first graphic event on the display device; and after completing the second partial rewriting, comparing the overlapping area between the first and second partial rewrites with the non-rewritten area and performing the partial rewrite of an area of the non-rewritten area except for the overlapping area.

7. A display method comprising the steps of:

initiating a first partial rewriting on a display for displaying a first graphic event having a display priority;

stopping the first partial rewriting remaining non-rewritten area on the display wherein the partial rewriting is not completed in response to a display instruction of a second graphic event having a display priority that is higher than the display priority of the first graphic event;

performing the second partial rewriting on the display for displaying the second graphic event partially overlapping with the first graphic event on the display; and comparing an overlapping area between the first and second partial rewrites with the non-rewritten area to perform the partial rewrite of the non-rewritten area except for the overlapping area, wherein when, during an execution of the first partial rewriting, a third graphic event of the same priority is generated, only a section not overlapping with the first partial rewriting area is stored, and after completing the first partial rewriting, the non-overlapping section is subjected to the rewriting.

* * * * *

UNITED STATES PATENT AND TRADEMARK OFFICE

CERTIFICATE OF CORRECTION

PATENT NO. : 5,481,274

DATED : January 2, 1996

INVENTOR(S) : Aratani et al.

It is certified that error appears in the above-indentified patent and that said Letters Patent is hereby corrected as shown below:

COLUMN 5:

Line 53, "will" should read --111--.

COLUMN 8:

Line 4, "Least" should read --least--.

COLUMN 11:

Line 56, "3· Vo" should read --3Vo--.
Line 64, "-3 Vo" should read -- -3Vo--.

Signed and Sealed this

Twenty-third Day of July, 1996

Bruce Lehman

*Attest:*

BRUCE LEHMAN

*Attesting Officer*

*Commissioner of Patents and Trademarks*